US009481968B2

(12) United States Patent
Aston et al.

(10) Patent No.: US 9,481,968 B2
(45) Date of Patent: Nov. 1, 2016

(54) BRIDGE SYSTEM AND METHOD INCLUDING FOUR SIDED CONCRETE BRIDGE UNITS ADAPTED FOR PROMOTING SEDIMENTATION

(71) Applicants: Scott D. Aston, Liberty Township, OH (US); Michael A. Blank, Tacoma, WA (US); Edward H. Zax, Miramar Beach, FL (US)

(72) Inventors: Scott D. Aston, Liberty Township, OH (US); Michael A. Blank, Tacoma, WA (US); Edward H. Zax, Miramar Beach, FL (US)

(73) Assignee: CONTECH ENGINEERED SOLUTIONS LLC, West Chester ( * ) Notice: Subject to any disclaimer, the term of this patent is extended or adjusted under 35 U.S.C. 154(b) by 45 days.

(21) Appl. No.: 14/321,060

(22) Filed: Jul. 1, 2014

(65) Prior Publication Data

US 2014/0314488 A1 Oct. 23, 2014

Related U.S. Application Data

(63) Continuation-in-part of application No. 13/613,710, filed on Sep. 13, 2012, now abandoned.

(60) Provisional application No. 61/535,565, filed on Sep. 16, 2011.

(51) Int. Cl.
*E01F 5/00* (2006.01)
*E02D 29/045* (2006.01)

(52) U.S. Cl.
CPC ..... *E01F 5/005* (2013.01); *E02D 29/045* (2013.01)

(58) Field of Classification Search
CPC ..... E01F 5/005; E02D 29/045
USPC ..... 405/126, 36, 43–49, 124
See application file for complete search history.

(56) References Cited

U.S. PATENT DOCUMENTS

| | | | | |
|---|---|---|---|---|
| 29,516 | A | 8/1860 | Parsons | |
| 1,184,634 | A * | 5/1916 | Duerrwachter | E21B 17/046 122/46 |
| 1,198,554 | A | 9/1916 | Jarvey | |
| 1,212,452 | A | 1/1917 | Caldwell | |
| 1,412,616 | A | 4/1922 | Kammerer | |
| 2,803,948 | A | 8/1957 | Dorfman | |
| 3,681,925 | A | 8/1972 | Schmunk et al. | |

(Continued)

FOREIGN PATENT DOCUMENTS

| | | | |
|---|---|---|---|
| JP | 08239891 | A * | 9/1996 |
| JP | 2005002689 | | 1/2005 |
| SE | 0003387 | | 11/2001 |

OTHER PUBLICATIONS

International Search Report and Written Opinion; mailed Oct. 1, 2013; PCT/US2012/054757, filed Dec. 9, 2012; 9 pgs.

(Continued)

*Primary Examiner* — Thomas B Will
*Assistant Examiner* — Katherine Chu
(74) *Attorney, Agent, or Firm* — Thompson Hine LLP

(57) ABSTRACT

A system providing environmentally friendly pathway tunnel utilizes bridge units having a bottom configuration with multiple elongated beams and slots. One or more of the beams includes upstanding sedimentation members that are spaced apart along a span of the tunnel. The system interacts with the flowing water and earthen material in the flowing water such that capture and settling of the earthen material at locations along the tunnel occurs to produce a more natural water flow pathway along the tunnel.

11 Claims, 26 Drawing Sheets

(56) References Cited

U.S. PATENT DOCUMENTS

| | | | | |
|---|---|---|---|---|
| 4,188,154 | A | 2/1980 | Izatt | |
| 4,245,924 | A | 1/1981 | Fouss et al. | |
| 4,360,042 | A | 11/1982 | Fouss et al. | |
| 4,527,319 | A | 7/1985 | Rosenbaum et al. | |
| 4,595,314 | A | 6/1986 | Lockwood | |
| 4,797,030 | A | 1/1989 | Lockwood | |
| 4,854,775 | A | 8/1989 | Lockwood | |
| 5,002,429 | A | 3/1991 | Roberts | |
| D404,835 | S | 1/1999 | Stute | |
| 6,041,829 | A | 3/2000 | Chancellor | |
| 6,517,283 | B2 | 2/2003 | Coffey | |
| 6,561,732 | B1 | 5/2003 | Bloomfield et al. | |
| D484,610 | S | 12/2003 | Lockwood | |
| D490,533 | S | 5/2004 | Lockwood | |
| D511,215 | S | 11/2005 | Vaia | |
| D511,387 | S | 11/2005 | Beach | |
| D514,706 | S | 2/2006 | Beach | |
| 7,137,756 | B1 | 11/2006 | Jones | |
| 7,758,282 | B2 * | 7/2010 | Suazo | E02B 5/02 405/118 |
| 8,789,337 | B2 | 7/2014 | Aston | |
| 2004/0179899 | A1 | 9/2004 | VanBuskirk | |
| 2005/0123354 | A1 | 6/2005 | Zax | |
| 2007/0099477 | A1 | 5/2007 | Burkhart | |
| 2007/0189853 | A1 * | 8/2007 | Tucker | E02B 8/085 405/80 |
| 2007/0253776 | A1 | 11/2007 | Robertson | |
| 2009/0183321 | A1 | 7/2009 | Boresi | |
| 2009/0279954 | A1 | 11/2009 | Griffith et al. | |
| 2010/0226721 | A1 * | 9/2010 | May | E03F 1/002 405/126 |
| 2011/0044759 | A1 | 2/2011 | Lancaster | |
| 2011/0150574 | A1 | 6/2011 | Semotiuk et al. | |
| 2011/0255922 | A1 | 10/2011 | Elliott | |
| 2012/0009018 | A1 | 1/2012 | Marquis et al. | |
| 2013/0071189 | A1 | 3/2013 | Aston et al. | |
| 2013/0121761 | A1 | 5/2013 | Dixon | |
| 2014/0305066 | A1 | 10/2014 | Wilson | |
| 2014/0314488 | A1 | 10/2014 | Aston | |

OTHER PUBLICATIONS

Barnard, R.J., et al. Water Crossings Design Guidelines, Washington Department of Fish and Wildlife, Olympia, Washington. http://wdfw.wa.gov/hab/ahg/culverts.htm, 2013.

B.M. Crookston and B.P. Tullis. A Laboratory Study of Stability in Bottomless Culverts. World Environmental and Water Resources Congress: Restoring Our Natural Habitat, 2007.

W.R. McKinley and R.D. Webb. A Proposed Correction of Migratory Fish Problems at Box Culverts, Fisheries Research Papers, vol. 1, No. 4, 33-45.

Kilgore, R., et al. Aquatic Organism Passage Design Guidelines for Culverts. World Environmental and Water Resources Congress: Bearing Knowledge for Sustainability, 2011, 1816-1825.

Katopodis, C., et al. A Study of Model and Prototype Culvert Baffling for Fish Passage, Fisheries and Marine Service Technical Report 828, Dec. 1978, 1-84.

B.G. Dane. Culvert Guidelines: Recommendations for the Design and Installation of Culverts in British Columbia to Avoid Conflict with Anadromous Fish, Fisheries & Marine Service Technical Report No. 811, Oct. 1978, 1-63.

Coulton, K.G., et al. Biological and Engineering Approaches to Fish Passage Problems. Engineering Approaches to Ecosystem Restoration, Wetlands 1998.

Mueller, R.P., et al. Juvenile Coho Salmon Leaping Ability and Behavior in an Experimental Culvert Test Bed, Transactions of the American Fisheries Society, 137:4, 941-950, 2008.

A.J. Kosicki and S.R. Davis. Consideration of Stream Morphology in Culvert and Bridge Design. Office of Bridge Development, Maryland State Highway Administration. Transportation Research Record 17 43, Paper. No. 01-2466, 2001, 57-59.

State of California, Resources Agency, Department of Fish and Game, Culvert Criteria for Fish Passage, May 2002, 1-17.

Poplar-Jeffers, I.O., et al. Culvert Replacement and Stream Habitat Restoration: Implications from Brook Trout Management in an Appalachian Watershed, U.S.A., Restoration Ecology vol. 17, No. 3, pp. 404-413, May 2009.

C.M. Frei and R. H. Hotchkiss. Design and Assessment Techniques for Fish Passage at Culverts and Bridges, World Environmental and Water Resources Congress 2006.

B.C. Singley and R.H. Hotchkiss. Differences between Open-Channel and Culvert Hydraulics: Implications for Design, World Environmental and Water Resources Congress 2010: 1278-1287.

MacPherson, L.M., et al. Effects of Culverts on Stream Fish Assemblages in the Alberta Foothills, North American Journal of Fisheries Management, 2012, 32:3, 480-490.

Bryant, M.D., Evaluation of a Small Diameter Baffled Culvert for Passing Juvenile Salmonids, United States Department of Agriculture, Forest Service, Pacific Northwest Forest and Range Experiment Station, Research Note, PNW-384, Apr. 1981.

Norman, J.M., et al. Technical Report Documentation Page: Hydraulic Design of Highway Culverts, Second Edition, Office of Bridge Technology, National Highway Institute, FHWA-NHI-01-020 HDS No. 5, Sep. 2001 (Revised May 2005).

Ecklund, Eileen, Fish Passage Removed From Streams: Making Way for Salmon; Government Publications/California—California Coast & Ocean vol. 25 Issue 2; 2009; pp. 26-27.

Feurich, Roberg, et al. Ecological Engineering: Improvement of Fish Passage in Culverts using CFD; Ecological Engineering 47 (2012) 1-8; Department of Hydraulic and Environmental Engineering.

Webb, Joseph R., et al.—Culvert Criteria for Fish Passage, State of California, Resources Agency, Department of Fish and Game, May 2002; pp. 1-17.

Ead, S.A. et.al., Generalized Study of Hydraulics of Culvert Fishways, Journal of Hydraulic Engineering/Nov. 2002, pp. 1018-1022.

Culvert Design for Aquatic Organism Passage, Hydraulic Engineering Circular No. 26, First Edition, U.S. Department of Transportation, Federal Highway Administration; Publication No. FHWA-HIF-11-008, Oct. 2010, 234 pages.

Mozes, Katheryn M., Hydraulic Stream-Simulation Design Option for Culvert Construction in Eastern Washington to Meet Fish Passage Criteria; How Big Is Enough?, Washington State University, Department of Civil and Environmental Engineering, Aug. 2008, 144 pages.

Rajaratnam, N., et al., Hydraulics of Culvert Fishways II: Slotted-Weir Culvert Fishways, Canada Journal of Civil Engineering, vol. 16, 1989, pp. 375-383.

Rajaratnam, N., et al., Hydraulics of Culvert Fishways III: Weir Baffle Culvert Fishways, Canada Journal of Civil Engineering, vol. 17, 1990, pp. 558-568.

Rajaratnam, N., et al., Hydraulics of Culvert Fishways IV: Spoiler Baffle Culvert Fishways, Canada Journal of Civil Engineering, vol. 18, 1991, pp. 76-82.

Rajaratnam, N., et al., Hydraulics of Culvert Fishways V: Alberta Fish Weirs and Baffles; Canada Journal of Civil Engineering, vol. 17, 1990, pp. 1015-1017.

Thurman, David R., et al., Hydrodynamics of Juvenile Salmon Passage in Sloped-Baffle Culverts, World Environmental and Water Resources Congress 2006, pp. 1-10.

Olsen, A.H., et al., Laboratory Study of Fish Passage and Discharge Capacity in Slip-Lined, Baffled Culverts, 2013 American Society of Civil Engineers, Journal of Hydraulic Engineering © ASCE/Apr. 2013, pp. 424-432.

Rajaratnam, N., et al., Hydraulics of Offset Baffle Culvert Fishways, Canadian Journal of Civil Engineering, vol. 15, 1988, pp. 1043-1051.

Alvarez-Vazqiez. et al., On the Optimal Design of River Fishways, Published online: Nov. 4, 2011, © Springer Science+ Business Media, LLC 2011, Optim Eng (2013) 14:193-211.

Parola, Jr., Arthur C., Pool Simulation Culvert Design for Fish Passage, World Environmental and Water Resources Congress 2008 Ahupua'am, © 2008 ASCE, pp. 1-9.

(56) References Cited

OTHER PUBLICATIONS

Hays, Matthew D., et al., Fish Passage Can Be Improved by Introducing Hydraulic Refuge. Can the Effects Be Quantified?, World Environmental and Water Resources Congress 2009: Great Rivers © 2009 ASCE, pp. 3092-3106.
David, B.O., et al., Remediation of a Perched Stream Culvert With Ropes Improves Fish Passage, Marine and Freshwater Research, 2012, 63-440-449, CSIRO Publishing.
Kemp, Paul S., et al., Response of Migrating Chinook Salmon (*Oncorhynchus tshawytscha*) Smolts to In-Stream Structure Associated With Culverts, River Research and Applications 24: 571-579 (2008); (Published online in Wiley InterScience), © 2008 John Wiley & Sons, Ltd.
Price, David M., Fish Passage Effectiveness of Recently Constructed Road Crossing Culverts in the Puget Sound Region of Washington State, North American Journal of Fisheries Management, 30:5, 1110-1125 (2010).
Slawski, Thomas M. & Ehlinger, Timothy J. (1998): Fish Habitat Improvement in Box Culverts: Management in the Dark?, North American Journal of Fisheries Management, 18:3, 676-685.
Franklin, Paul A., et al., Restoring Connectivity for Migratory Native Fish in a New Zealand Stream: Effectiveness of Retrofitting a Pipe Culvert, Aquatic Conserv: Mar. Freshw. Ecosyst. 22:489-497 (2012).
Crookston, B.M., et al., Scour Prevention in Bottomless Arch Culverts, International Journal of Sediment Research, vol. 27, No. 2, 2012. pp. 213-225.
Wargo, Rebecca S., et al., A Comparison of Single-Cell and Multicell Culverts for Stream Crossings, Journal of the American Water Resources Association, Aug. 2006, pp. 989-995.
Morrison, Ryan R., et al., Turbulence Characteristics of Flow in a Culvert With Sloped-Weir Baffles, World Environmental and Water Resources 2006, © ASCE 2006, pp. 1-10.
Morrison, Ryan, R., et al., Turbulence Characteristics of Flow in a Spiral Corrugated Culvert Fitted With Baffles and Implications for Fish Passage, Ecological Engineering 35 (2009) pp. 381-392.
Anderson, Gregory B., et al., Dealing With Uncertainty When Assessing Fish Passage Through Culvert Road Crossings, Environmental Management (2012) 50:462-477.
Pearson, W.H., Evaluation of Juvenile Salmon Leaping Ability and Behavior at an Experimental Culvert Test Bed, Final Rpt, Jun. 2005, Washington State Department of Transportation, WSDOT Agreement No. GCA2677, Battelle Pacific Northwest Division, Richland, Washington. (PNWD-3539).
MacDonald, J.I., et al., Improving the Upstream Passage of Two Galaxiid Fish Species Through a Pipe Culvert, Fisheries Management and Ecology, 2007, 14, 221-230, (© 2007 The Authors, Journal compilation © 2007 Blackwell Publishing Ltd.)
Park, David, et al., Landscape-Level Stream Fragmentation Caused by Hanging Culverts Along Roads in Alberta's Boreal Forest, (Can. J. For. Res. 38:566-575 (2008)).
Fitch, G. Michael, Nonanadromous Fish Passage in Highway Culverts, Final Report, Virginia Transportation Research Council, Rept. No. VTRC 96-R6, Oct. 1995, 18 pgs (Project No. 3041-010).
Goodridge, Wade, H., Sediment Transport Impacts Upon Culvert Hydraulics, Utah State University, Logan Utah, 2009, 381 pages.
PCT, International Search Report and Written Opinion, International Application No. PCT/US2015/037573; date of mailing Sep. 11, 2015, 9 pages.

* cited by examiner

BRIDGE SYSTEM AND METHOD INCLUDING FOUR SIDED CONCRETE BRIDGE UNITS ADAPTED FOR PROMOTING SEDIMENTATION

CROSS-REFERENCES

This application is a continuation-in-part of U.S. application Ser. No. 13/613,710, filed Sep. 13, 2012, which claims the benefit of U.S. Provisional Application Ser. No. 61/535,565, filed Sep. 16, 2011, each of which is incorporated herein by reference.

TECHNICAL FIELD

The present application relates to the general art of precast concrete bridge and culvert units, and to the particular field of four-sided bridge and culvert units.

BACKGROUND

Overfilled bridge structures are frequently formed of precast reinforced four-sided concrete units commonly referred to as arch units, arch culverts, box units or box culverts. As used herein the terminology four-sided bridge unit encompasses all of such structures. The units are used in the case of bridges to support one pathway over a second pathway, which can be a waterway. Four-sided bridge units have a bottom wall structure that facilitates on-site placement with reduced need for foundation preparation.

In the past, the four-sided bridge units of overfilled bridge structures have been constructed with bottom wall structures having a generally planar and continuous top surface and a generally uniform thickness. There is an increasing demand for construction efforts to provide more natural environments and/or to decrease impact on wildlife.

A four-side bridge unit adapted to create a more natural environment through the pathway defined by the bridge units and/or adapted to reduce impact on fish migrations would be desirable.

SUMMARY

In one aspect, a method of providing an environmentally appealing region for water flow along an surrounded pathway tunnel is provided. The method involves: providing a plurality of four-sided concrete bridge units in abutting relationship to create a surrounded pathway tunnel, one end of the tunnel located upstream along a water path and an opposite end of the tunnel located downstream along the water path; allowing water to flow through the surrounded pathway tunnel during a rain or other flow event; and providing a multiplicity of the four-sided bridge units with a corresponding bottom wall structure that interacts with the flowing water and earthen material in the flowing water such that capture and settling of the earthen material at locations along the tunnel occurs to produce a more natural water flow pathway along the tunnel.

The bottom wall structure of each of the multiplicity of the four-sided bridge units may be provided with a plurality of through openings such that at least forty percent of the bottom wall structure is open. For example, at least fifty percent of the bottom wall structure of each of the multiplicity of the four-sided bridge units may be open.

A lip structure may be provided at a top portion of at least some of the through openings, the lip structure facing upstream.

The plurality of openings of each bottom wall structure may be arranged in rows that extend along a span of the respective four-sided bridge unit.

The plurality of openings may be formed in the shape of elongated slots, each elongated slot defining a row, such that multiple beams are formed in the bottom wall structure and also extend along the span. At least one beam with a height that is greater than a height of another beam, the higher beam interacting with the flowing water and earthen material to reduce flow velocity and thereby enhance settling out of earthen material. By providing a lip structure along at least one beam, the lip structure extending in an upstream direction into an adjacent elongated slot, wash out of earthen material that has settled in the adjacent elongated slot can be limited.

The plurality of openings may be provided as multiple series of openings, each series of openings forming a respective row. By staggering openings of adjacent rows, nesting of the openings is achieved. By providing upper lip structure along one or more edges of at least some of the openings, the lip structure extending into its respective opening, wash out can be limited.

By providing the bottom wall structure of each of the multiplicity of the four-sided bridge units with a recessed portion, a low flow channel through which marine life can travel is created.

In another aspect, a bridge system provides a surrounded water flow pathway tunnel adapted to produce an environmentally friendly tunnel bottom. The system includes a plurality of four-sided precast concrete bridge units in abutting relationship to create the surrounded water flow pathway tunnel, one end of the pathway tunnel located upstream along a natural water path and an opposite end of the pathway tunnel located downstream along the natural water path. Each of the four-sided precast concrete bridge units includes: spaced apart side walls interconnected by a top wall, and a bottom configuration formed by a plurality of precast concrete beams extending from one side wall to the other sidewall and that are spaced apart along a depth of the bridge unit to define a plurality of elongated through openings for interacting with flowing water and earthen material in flowing water to enhance capture and settling of earthen material along the pathway tunnel, wherein each of the plurality of elongated through openings extends from one side wall to the other side wall to provide full span connectivity between the pathway tunnel and the underlying ground along each elongated through opening, each elongated precast concrete beam having a bottom side that is in a common plane with a bottom surface of each of the side walls so as to aid in transferring load to ground below the bridge unit, wherein at least one elongated precast concrete beam has a configuration that is different than a configuration of another one of the elongated precast concrete beams.

In one implementation, at least forty percent of the bottom configuration of each of the four-sided precast concrete bridge units is open.

In one implementation, in the case of each of the four-sided precast concrete bridge units, at least one elongated precast concrete beam has a depth that is greater than a depth of another one of the elongated precast concrete beam.

In one implementation, in the case of each of the four-sided precast concrete bridge units, haunch sections connect the elongated precast concrete beams with the side walls.

In one implementation, in the case of each of the four-sided precast concrete bridge units, at least one elongated precast concrete beam includes a plurality of upwardly projecting sedimentation members spaced apart in a spanwise direction to define gaps between the sedimentation members.

In one implementation, in the case of each of the four-sided precast concrete bridge units, at least one sedimentation member has a height that is different than a height of another sedimentation member.

In one implementation, in the case of each of the four-sided precast concrete bridge units, each sedimentation member has a height that is between about ten percent and about twenty-seven percent of a clear height of the pathway tunnel at top dead center.

In one implementation, in the case of each of the four-sided precast concrete bridge units, each gap between the sedimentation members is between about six percent and about twelve percent of the span of the pathway tunnel.

In one implementation, in the case of each of the four-sided precast concrete bridge units, a center to center spacing between adjacent sedimentation members is between about twelve percent and about seventeen percent of the span of the pathway tunnel.

In one implementation, in the case of each of the four-sided precast concrete bridge units, at least one of the elongated precast concrete beams lacks any sedimentation members, such that a depthwise center-to-center spacing along the pathway tunnel between elongated precast concrete beams having sedimentation members is between about thirty percent and about seventy percent of the span of the pathway tunnel.

In one implementation, in the case of each of the four-sided precast concrete bridge units, a first one of the elongated precast concrete beams at one end of the bridge unit lacks any sedimentation members and a second one of the elongated precast beams at an opposite end of the bridge unit includes sedimentation members, and the plurality of four-sided precast concrete bridge units are arranged such that, in the case of adjacent bridge units, the first elongated precast concrete beam of one bridge unit abuts the second elongated precast concrete beam of the other bridge unit.

In one implementation, in the case of each of the four-sided precast concrete bridge units, sedimentation members located toward the side walls have heights that are greater than heights of sedimentation members located towards a spanwise center of the pathway tunnel.

In one implementation, at least a most upstream one of the bridge units is installed such that a top of a shortest one of the sedimentation members of the most upstream bridge unit is substantially aligned in height with an invert of the incoming water flow path.

DETAILED DESCRIPTION

Figure 1:
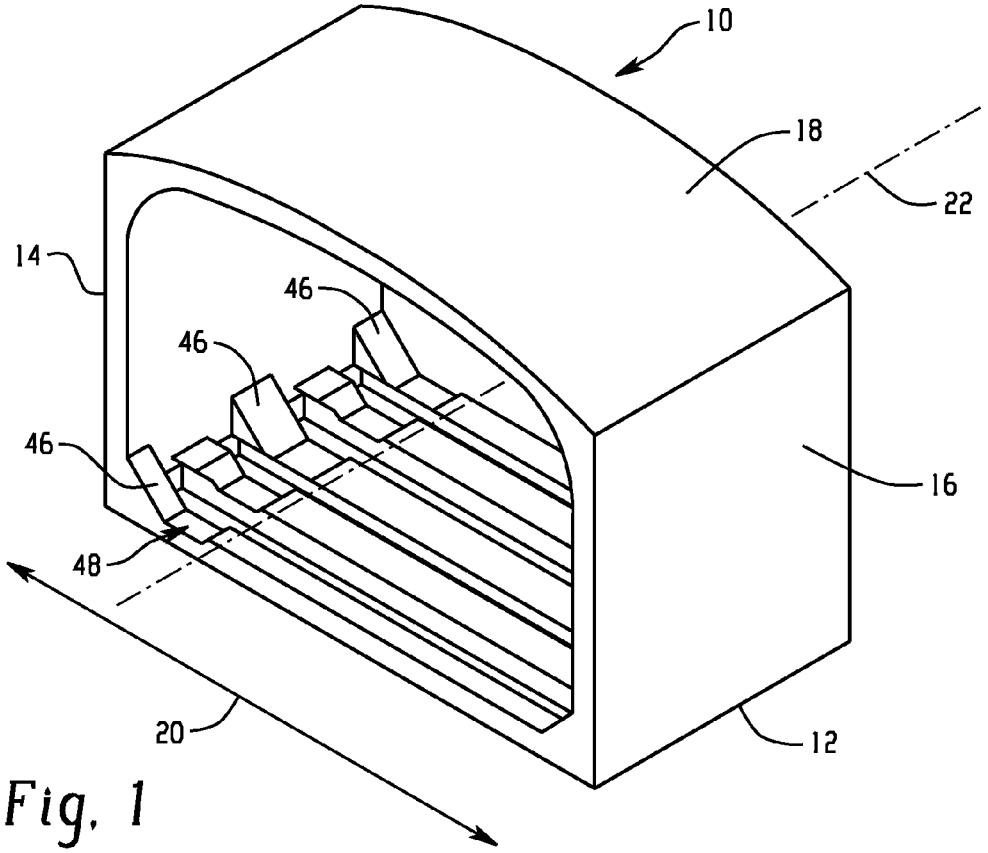
FIG. 1 is a perspective view of one embodiment of a four-sided bridge unit.
Figure 2:
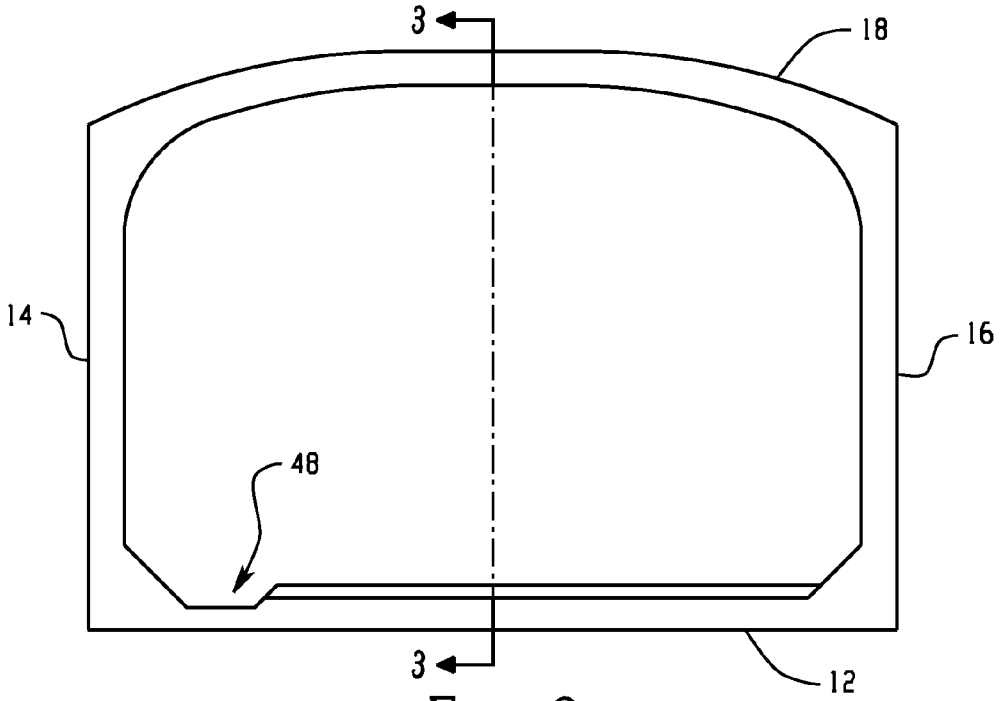
FIG. 2 is an end elevation of the bridge unit of FIG. 1.

Referring to FIGS. 1-4, a four-sided precast concrete bridge unit 10 is shown. In the illustrated embodiment bridge unit 10 is formed by a generally horizontal extending bottom wall 12, substantially vertically upward extending side walls 14 and 16 at the ends of the bottom wall and a top wall 18 having a generally arch-shaped configuration. However, four sided bridge units having top walls other than arch-shaped (e.g., flat top walls) are also contemplated. Likewise, side walls other than vertical are possible. As used herein, the terms "length" and "span" of an individual unit or portions of the unit refers to a horizontal dimension extending parallel with the direction of arrow 20 (which is substantially perpendicular to a horizontal through axis 22 of the unit) and the terms "width" and "depth" of the individual unit or portions of the unit refer to a horizontal dimension extending parallel to the through axis 22. As used herein the term "arch" and "arch-shaped" when referring to the top of an arch unit means a curved shape (including constant radius curves, curves with multiple radii, curves with continuously varying radius) or any top wall shape that is higher in the middle of the top wall as opposed to where the top wall meets the side walls (e.g., an inverted V-shape or a combination of three or more planar segments angularly arranged with respect to each other to produce a vaulted top wall or a combination of curved segments and flat segments that produce a vaulted top wall).

The bottom, top and side walls are preferably precast as a single monolithic structure in a single casting operation. However, in certain implementations, one or more walls may be cast separately and then connected together by suitable connecting structure (e.g., reinforcing bars or by casting one or more elements separately and then placing that cast element in the formwork that is used to cast the final structure).

The bottom wall 12 of the unit 10 is shaped and configured to facilitate both sedimentation within and passage of marine life once the unit is installed. Specifically, the bottom wall 12 includes a plurality of elongated, spanwise extending through openings that extend completely through the thickness of the bottom wall 12. As shown, each elongated opening 24 has a length $L_O$ that is at least about sixty percent of the overall width of the unit $L_U$ (e.g., $L_O$ is at least about 70% of $L_U$, such as for example, between 80% and 95% of $L_U$). However, other variations are possible. Intermediate beams 26 separate the elongated openings 24 and serve to maintain a rigid connection between the lower ends of the side walls 14 and 16. Edge located beams 28 are also provided, thereby providing a continuous peripheral support surface at the lower side of the bottom wall. The lower surface of each beam 28 is preferably in common plane with the continuous peripheral support surface to provide added stability and distribution of loads. As shown, roughly about 40% to 60% (e.g., about 45% to 55%) of the lower side of the bottom wall makes up the support or resting surface of the bridge unit and the remainder (about 60% to 40%) is open via the openings 24. However, other variations are possible. Lengthwise extending reinforcement may be provided in each of the beams for structural integrity, with some continuity provided between that reinforcement and the reinforcement of the vertical side walls.

Figure 3:
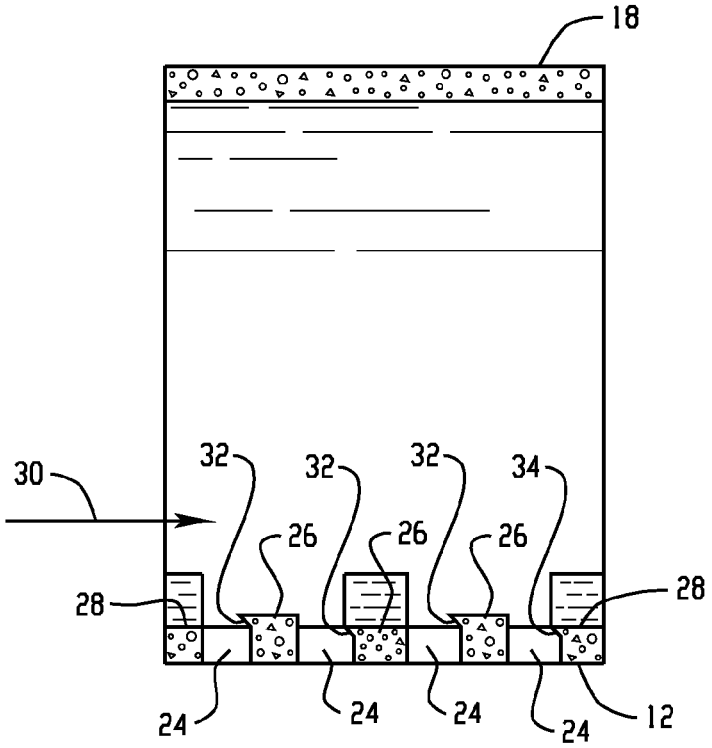
FIG. 3 is a cross section along line 3-3 of FIG. 2.
Figure 4:
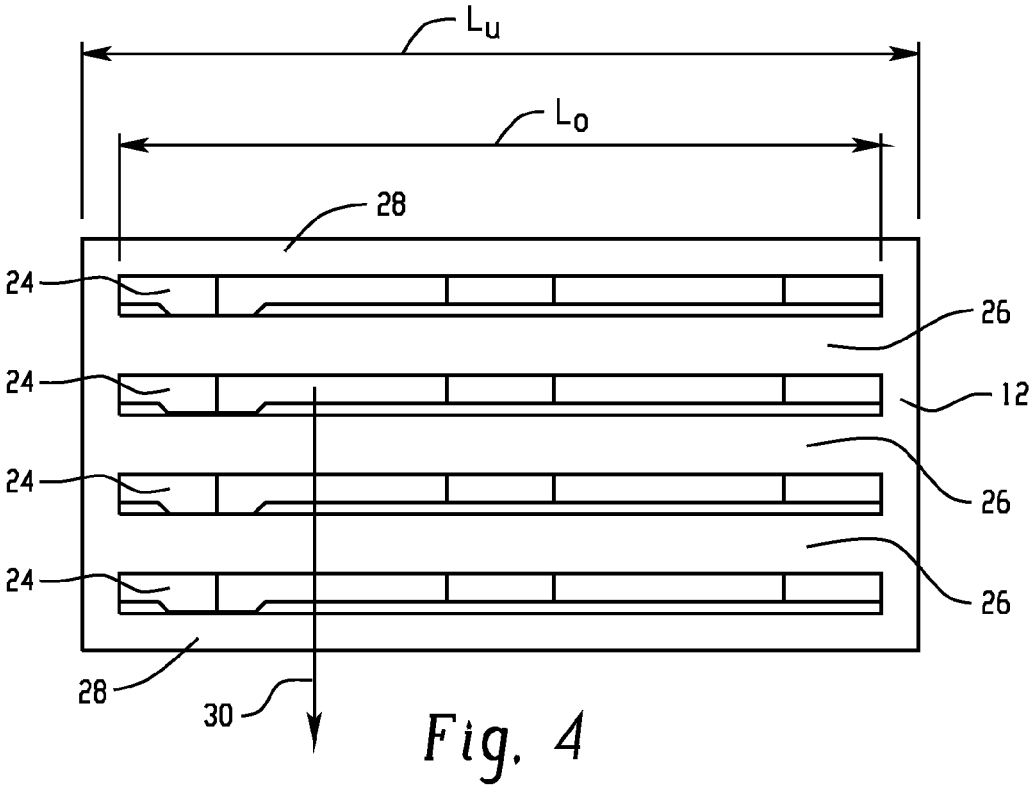
FIG. 4 is bottom view of the bridge unit of FIG. 1.

As seen in FIG. 3, where the anticipated water flow direction through the bridge unit is shown by arrow 30, the combination of the beams 26, 28 and the openings 24 are configured to promote sedimentation at the bottom of the bridge unit. Specifically, the beams 26 and one of the beams 28 are formed with a lip structure 32 and 34 that overhangs the adjacent opening 24 and extends from the beam in an upstream direction. Also, one or more of the beams 28 has a thickness or height that exceeds that of the adjacent beams 26 and/or 28. The effect of this configuration is best described with reference to FIGS. 5 and 6, where FIG. 5 shows two units 10 in edge to edge relationship as such units would typically be installed on a job site and FIG. 6 shows an enlarged partial view with a flow pattern.

Figure 5:
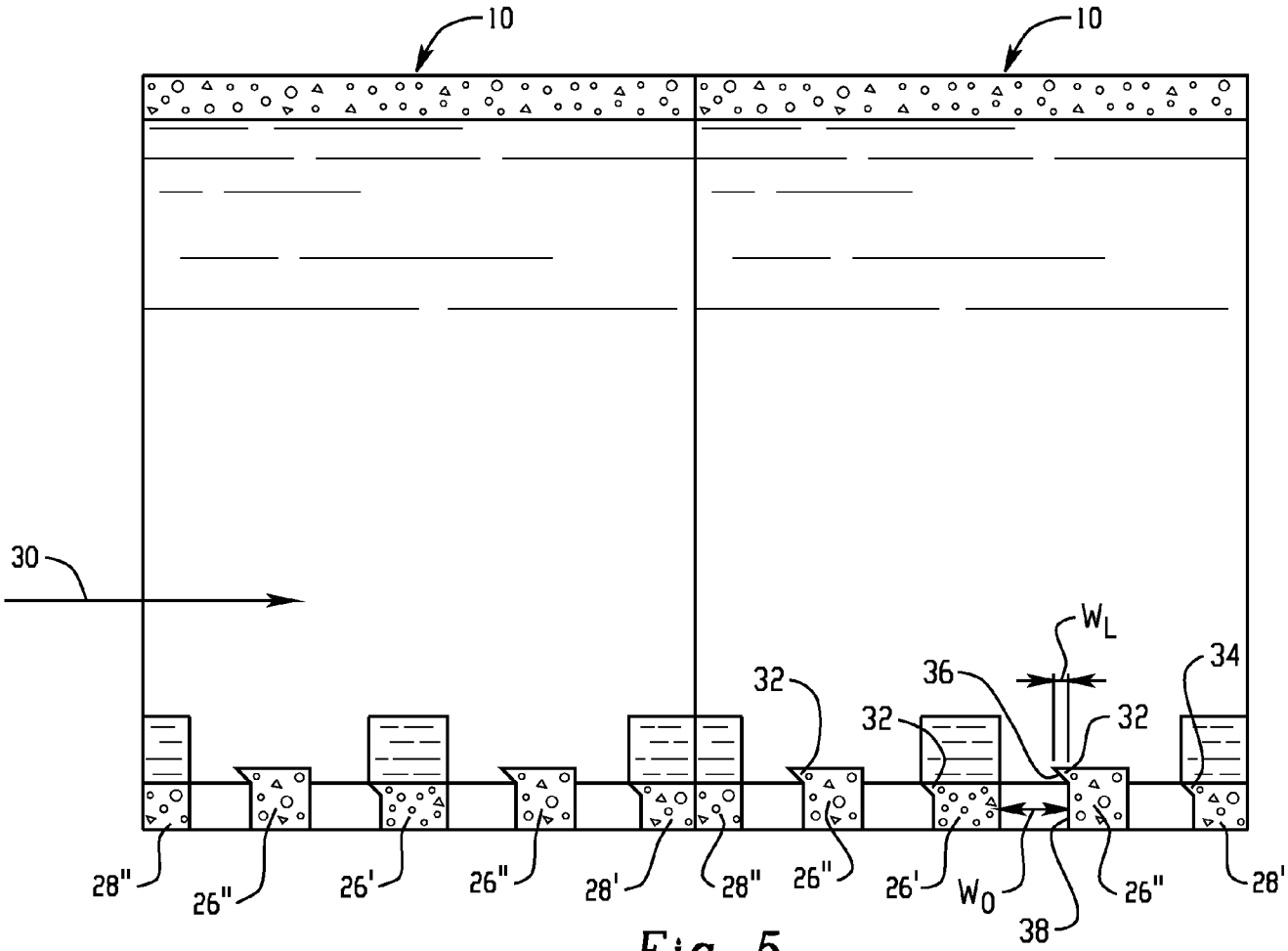
FIG. 5 is a cross-sectional view of two bridge units of FIG. 1 arranged edge to edge.

As seen in FIG. 5, the edge located beams 28" (located at the upstream flow edge of the units) lack any upstream facing lip structure while the edge located beams 28' (located at the downstream flow edge of the units) incorporates an upstream facing lip structure. In this manner, when two units 10 are installed edge to edge, there is no lip structure to interfere with the placement and the adjacent beams 28' and 28" combine to form effective beam that is similar in overall configuration and size to intermediate beam 26'. In this regard, the width of the beam structures 28' and 28" is preferably smaller than the width of beam structures 26' and 26" (e.g., on the order of about 50% to about 60% of the width of beam structures 26' and 26") so that the overall width of the effective beam is more consistent with the overall width of the beams 26' and 26". The height of beams 26" is greater than the height of beams 26', 28' and 28" as shown. Beams 26', 28' and 28" have the same thickness or height and beams 26" may have a thickness or height that is about 110% to about 140% greater (e.g., about 120% to about 130% greater). However, variations are possible. The width $W_L$ of the lip structure may be on the order of about 10% to 20% of the overall width $W_O$ of the opening 24. In the illustrated embodiment, a tapered surface 36 connects the vertical side surface 38 of the beam with the protruding edge of the lip.

Figure 6:
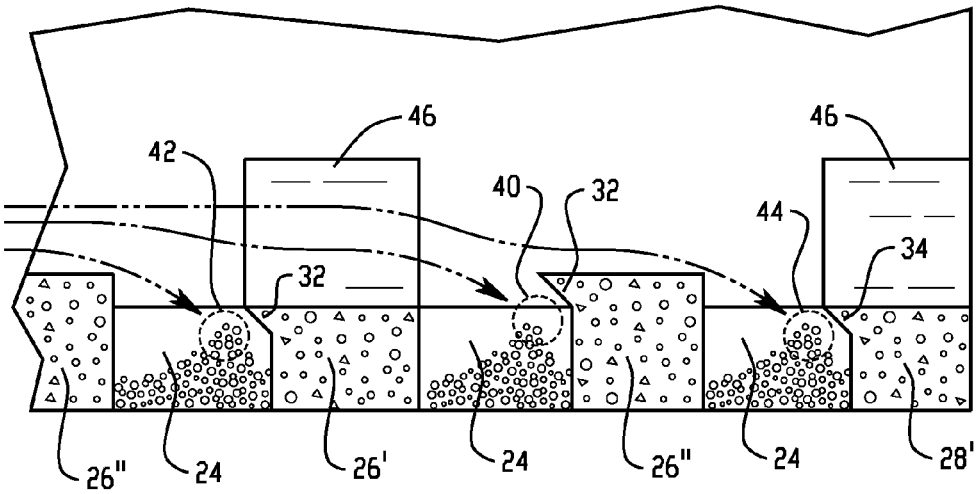
FIG. 6 is an enlarged partial view of the cross-section of FIG. 5.

Referring to FIG. 6, as water flows through the units the higher beams tend to reduce the velocity in the vicinity 40 of an opening 24 which tends to cause sediment to drop out of the flow and into the opening. The lip structure 32 helps prevent washout of any sediment that builds up in the openings 24. The lip structures 32 and 34 of the shorter beams 26' and 28' also help prevent washout in respective openings and creates respective areas 42 and 44 of lower velocity that can promote sedimentation.

Figure 9:
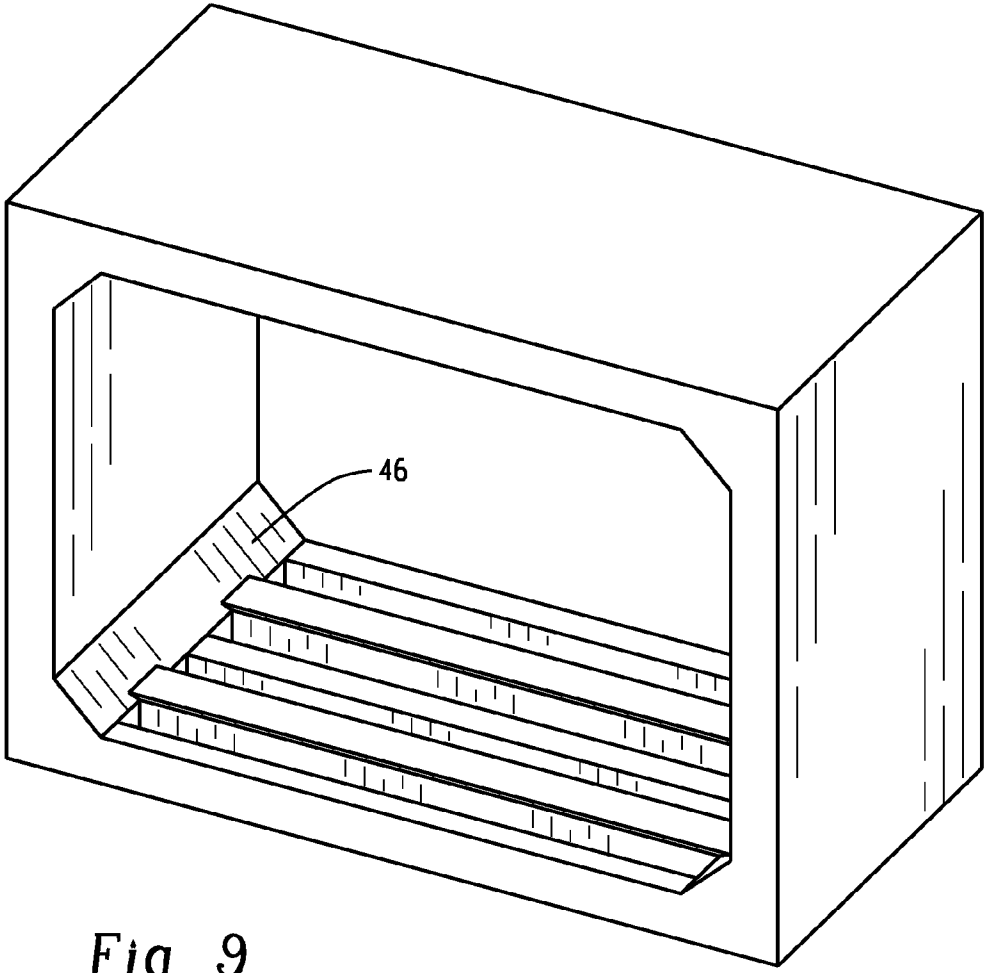
FIGS. 9 and 10 show perspective views of another embodiment of a four-sided bridge unit in which continuous haunches are provided in the corners where the bottom wall meets the side walls.
Figure 10:
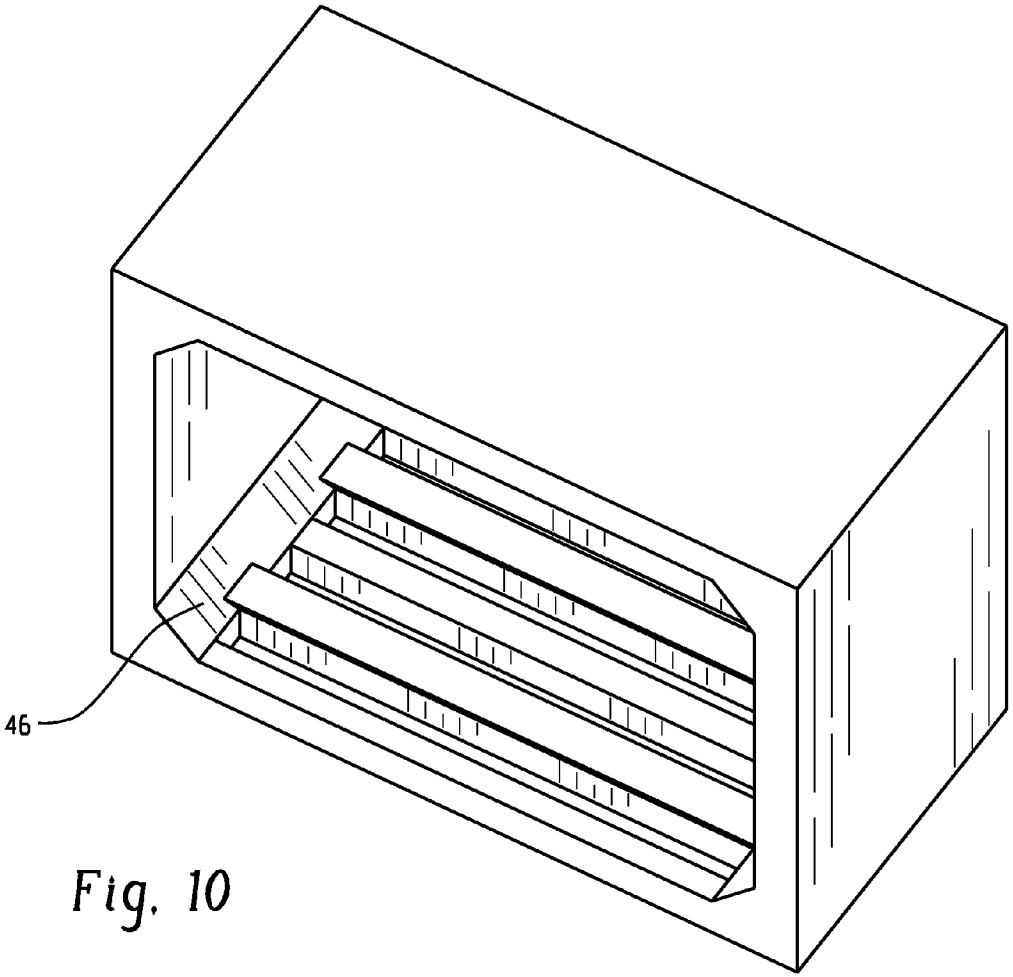
Figure 11:
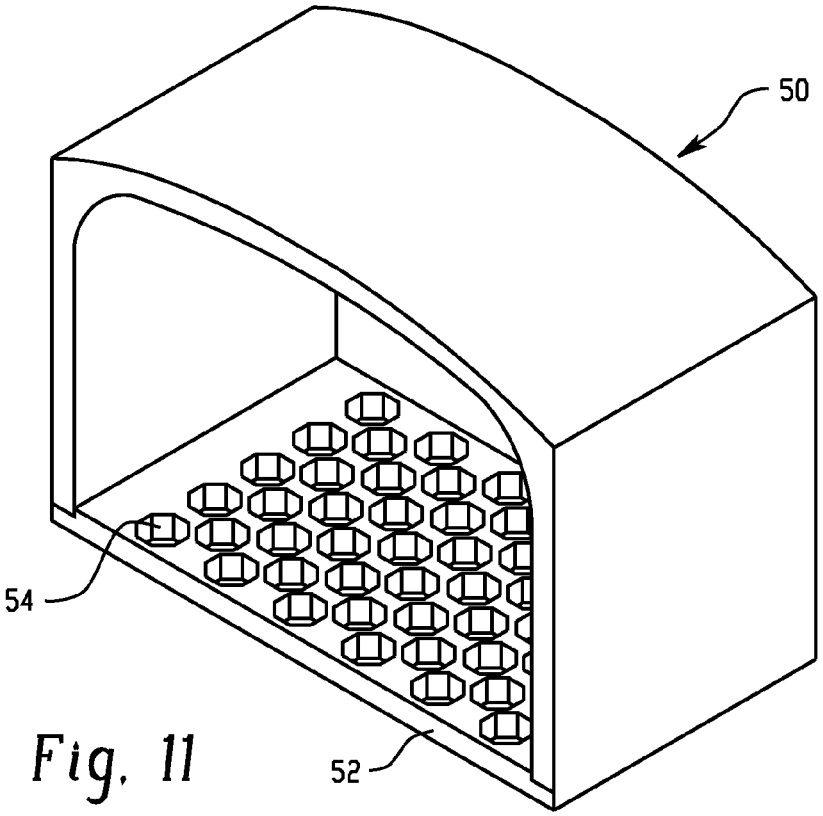
FIG. 11 is a perspective view of yet another embodiment of a four-sided bridge unit.
Figure 12:
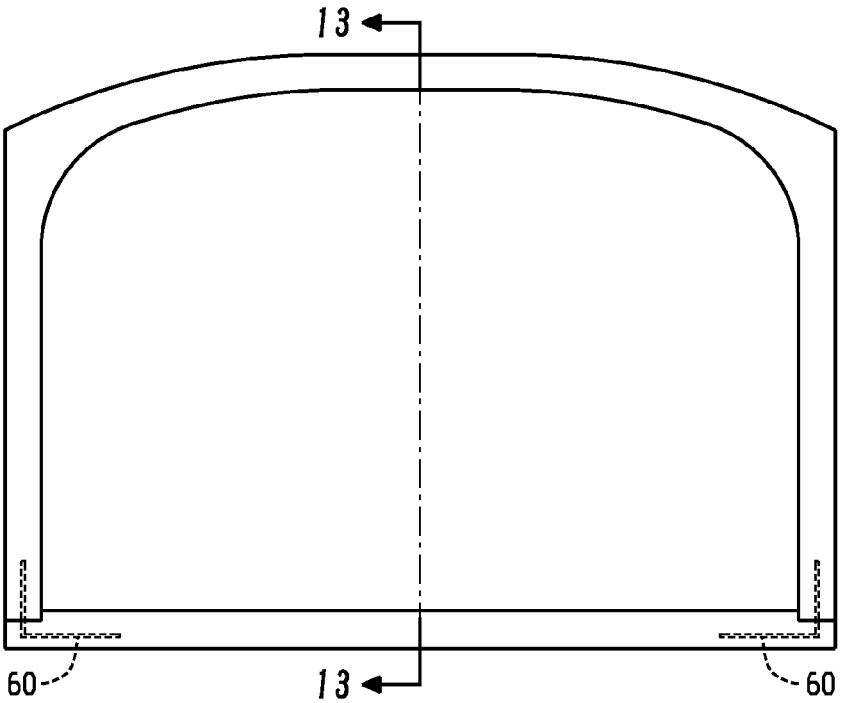
FIG. 12 is an end elevation of the bridge unit of FIG. 11.
Figure 13:
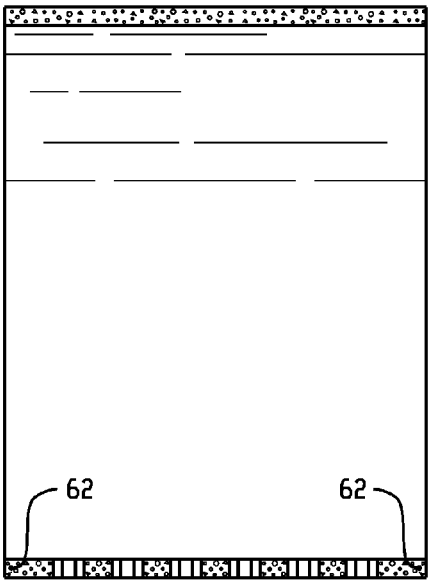
FIG. 13 is a cross section along line 13-13 of FIG. 12.

In the illustrated embodiment, the connection of every other beam to the vertical side wall includes a haunch 46, which may include reinforcement, to resist the moment loads in the corners. Placing the haunches in a spaced apart manner, rather than providing a continuous haunch, can also help promote sedimentation. However, continuous haunches are also contemplated for some applications, as reflected in the embodiment of FIGS. 9 and 10. In this embodiment, the relative length of the slotted openings 24 (as compared to overall length of the unit) is smaller than that shown in FIG. 4 in order to accommodate the haunch 46. Moreover, FIGS. 9 and 10 show a four-sided bridge unit with a flat top wall structure rather than an arched top wall structure.

Figure 7:
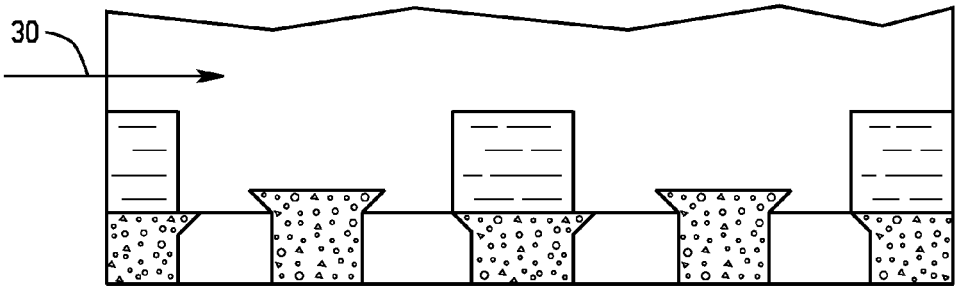
FIG. 7 shows a partial cross-section of an embodiment of a unit with both upstream and downstream facing lips.
Figure 8:
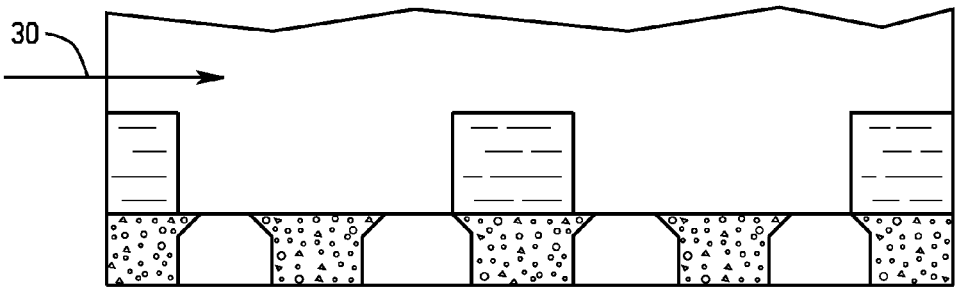
FIG. 8 shows a partial cross-section of an embodiment of a unit in which the beams all have a common height.

While the embodiment of FIGS. 1-6 contemplates upstream facing lips only, in an alternative embodiment downstream facing lips may also be provided on the beams as shown in FIG. 7. Likewise, embodiments in which all the beams have a common height are contemplated, as shown in FIG. 8.

Referring again to FIGS. 1, 2 and 4, and regardless of the relative height of the plurality of beams, each of the beams may be formed with a section 48 of reduced thickness to create a low flow channel through the unit, making it easier for marine life (e.g., fish) to travel through the unit. The reduced thickness sections 48 may be formed without any lip structures.

Figure 14A:
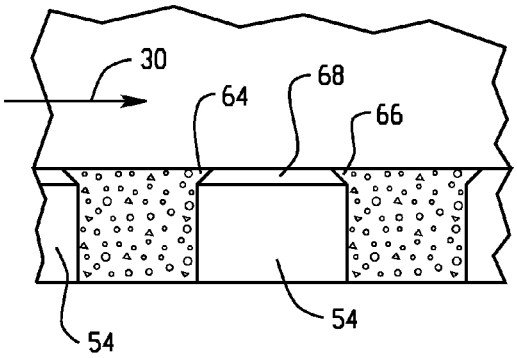
FIG. 14A is a partial cross-section along line 14A of FIG. 14.
Figure 14:
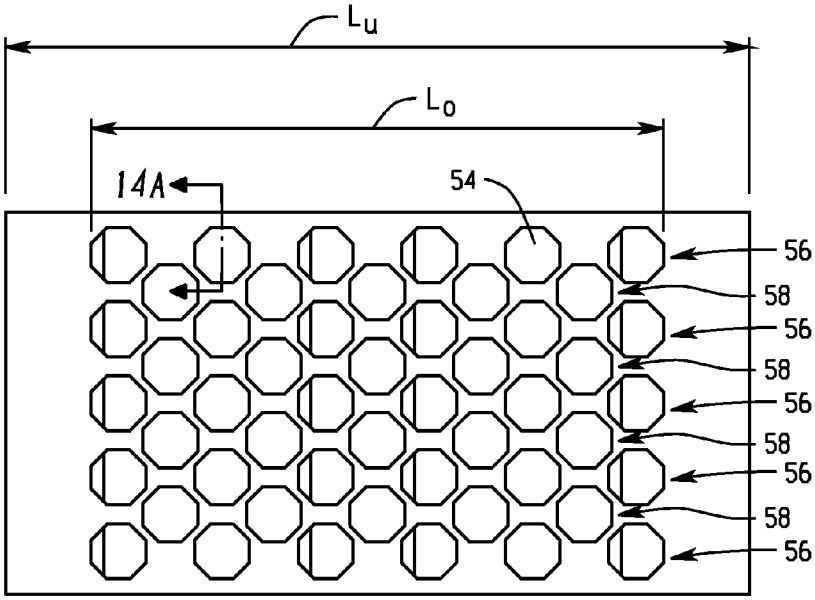
FIG. 14 is bottom view of the bridge unit of FIG. 11.
Figure 15:
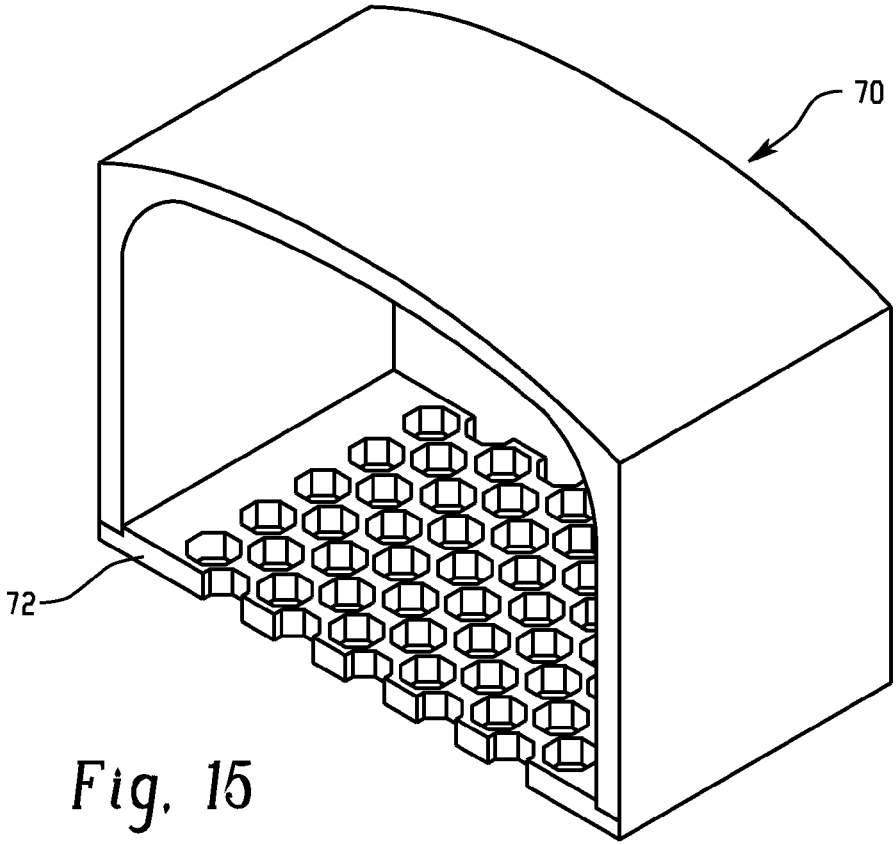
FIG. 15 is a perspective view of still another embodiment of a four-sided bridge unit.
Figure 16:
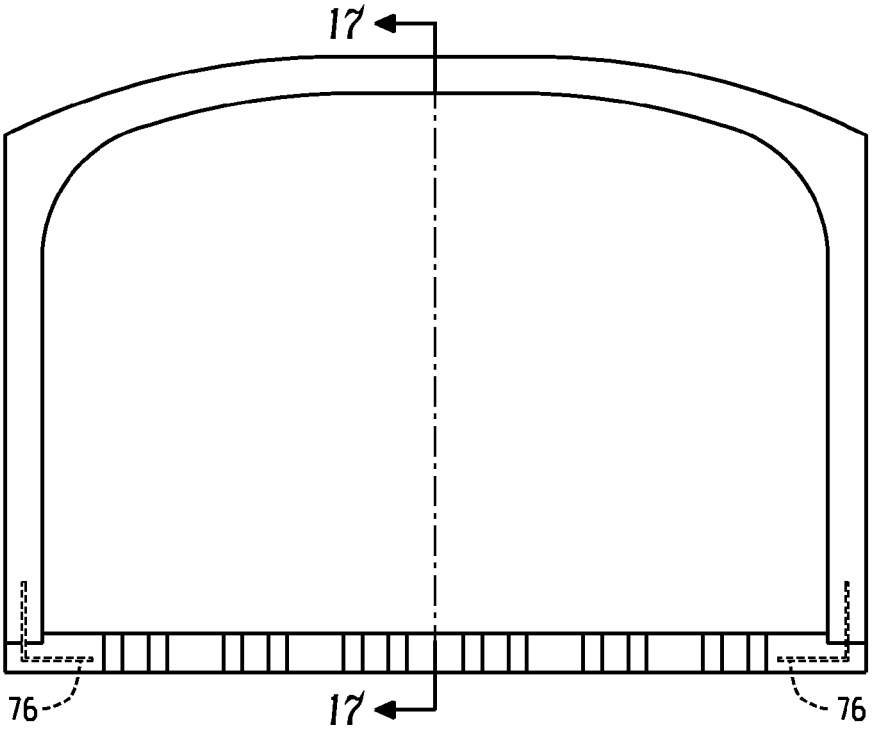
FIG. 16 is an end elevation of the bridge unit of FIG. 15.
Figure 17:
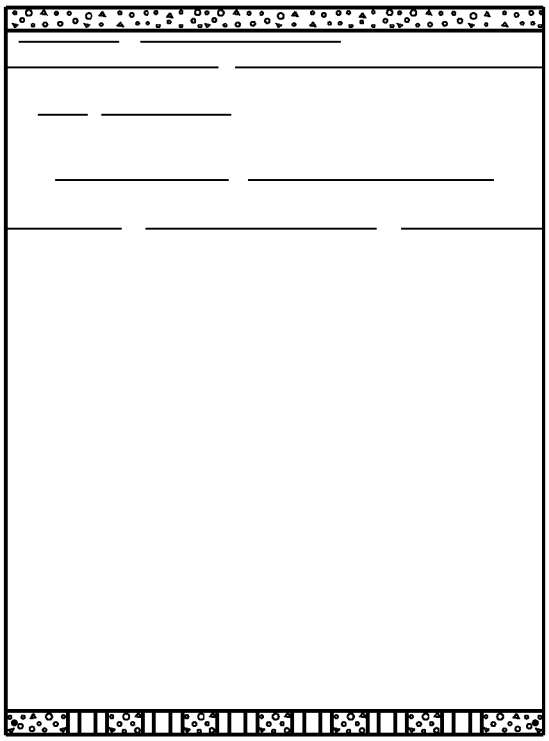
FIG. 17 is a cross section along line 17-17 of FIG. 16.
Figure 18:
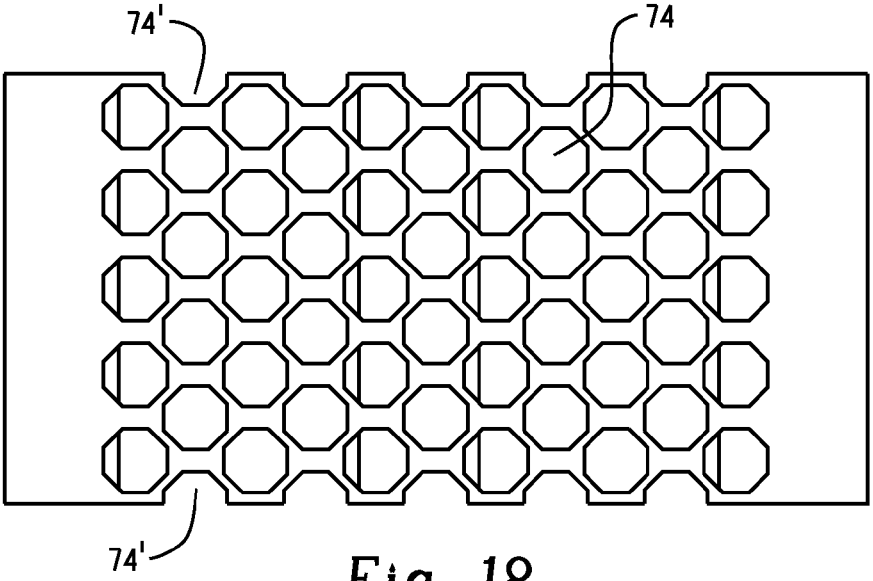
FIG. 18 is bottom view of the bridge unit of FIG. 15.

An alternative embodiment of a four-side bridge unit 50 adapted for sedimentation is shown in FIGS. 11-14. As shown, the bottom wall 52 of the bridge unit 50 includes a plurality of openings 54. The openings are arranged in a plurality of lengthwise extending rows 56 and 58, with the rows 56 and 58 arranged in an alternating and staggered relationship that provides some nesting of the openings of one row into the spaces between the openings of another row. The openings are distributed along a lengthwise extending mid-portion $L_O$ of the bottom wall 52 that represents between about 50% to about 80% of the overall length $L_U$ of the bottom wall of the unit. In this manner, the bottom wall lacks any openings in roughly about the first 10% to 25% of the extent of the bottom wall from its ends. Reinforcement 60 may be located in this area for structural integrity. Likewise, as the edges of the bottom wall are continuous, lengthwise reinforcement 62 may be included along such edges as well. About 75% to about 90% of the bottom wall in the mid-portion $L_O$ may be open space, while only about 55% to about 70% of the overall area of the bottom wall (as viewed from the bottom) may be open space. As shown in FIG. 14A, the openings 54 may include lip structure to promote sedimentation and reduce washout effects. The lip structure may be upstream facing lip structure 66, downstream facing lip structure 64 and/or lengthwise facing lip structure 68.

A further embodiment of a four-sided bridge unit 70 is shown in FIGS. 15-18. In this embodiment the openings 74 of the unit actually include rows of partial openings along each edge. The partial openings 74' are preferably about one half the size of a regular opening such that when one unit is abutted with another unit the partial openings combine to effectively form an opening similar in size and shape to the openings 74. The mid-point arrangement of the openings along the length of the bottom wall 72 may be similar to that of the embodiment of FIGS. 11-14, with reinforcement 76 in the end areas of the bottom wall 72. However, due to the edge openings 74', no reinforcement is provided in the mid-section where the openings are located. The openings 74 of the unit 70 may also include lip structure as described relative to FIG. 14A.

Figure 19A:
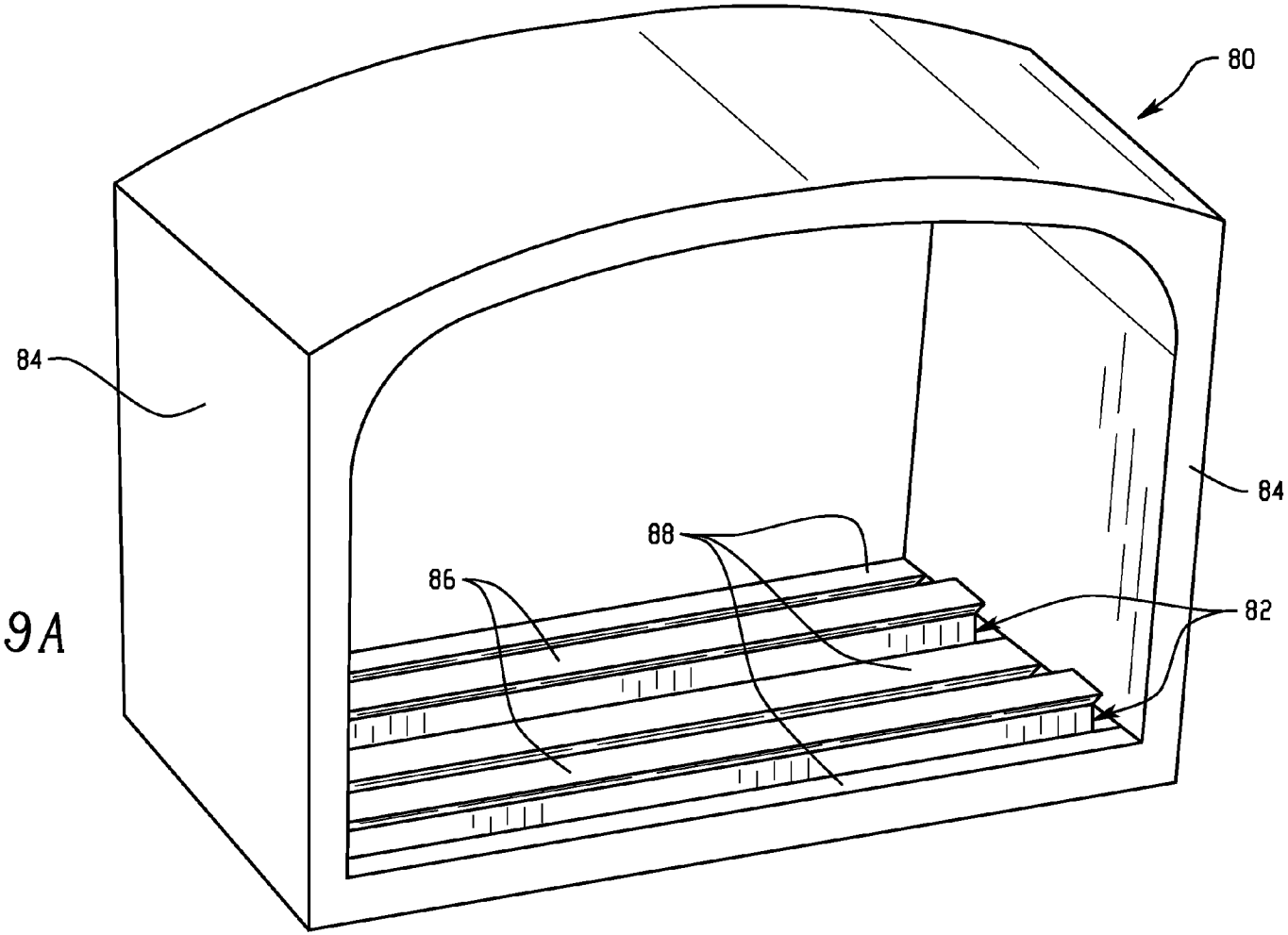
FIGS. 19A-B show another embodiment of a bridge unit.
Figure 19B:
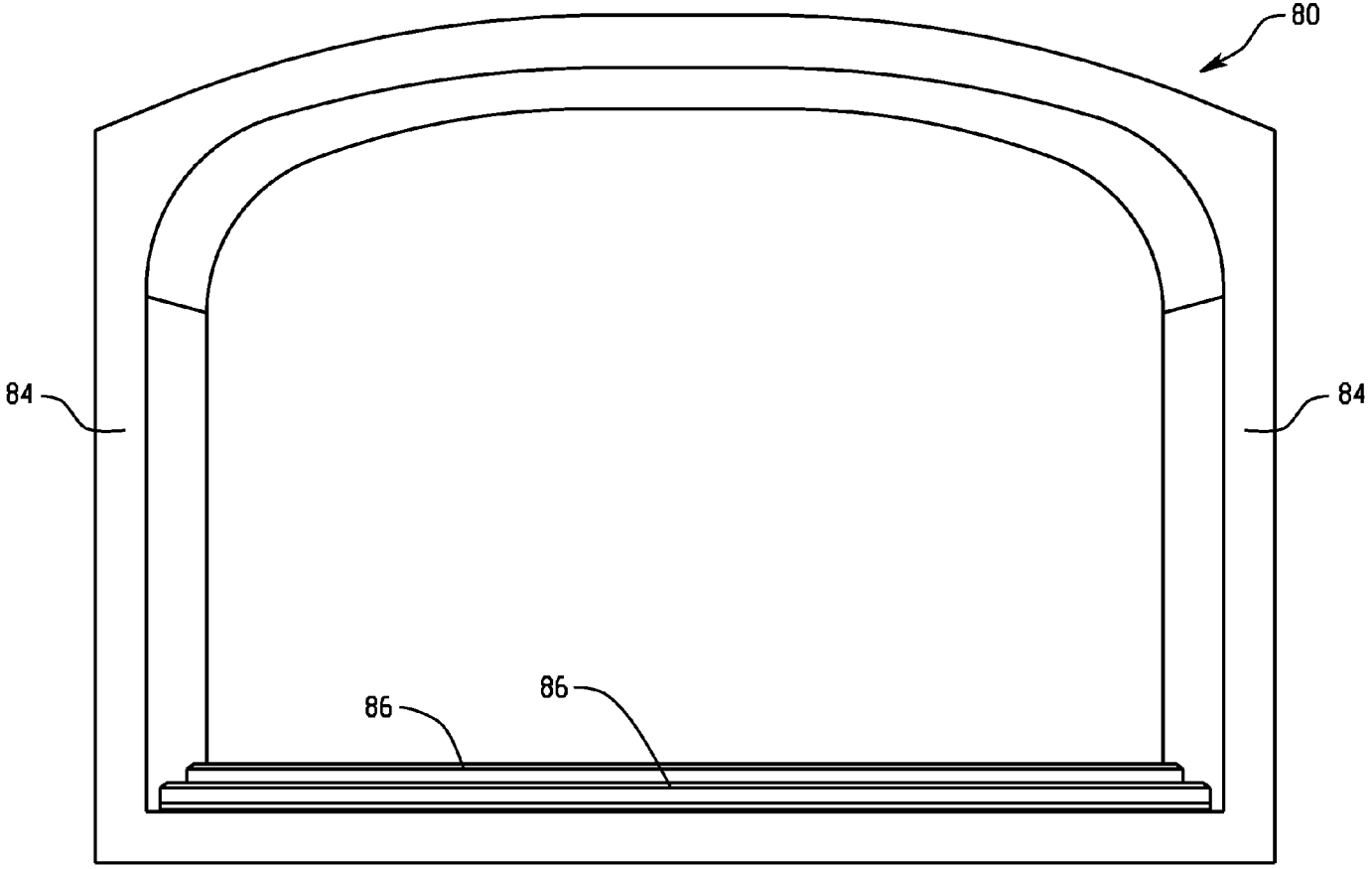
Figure 20A:
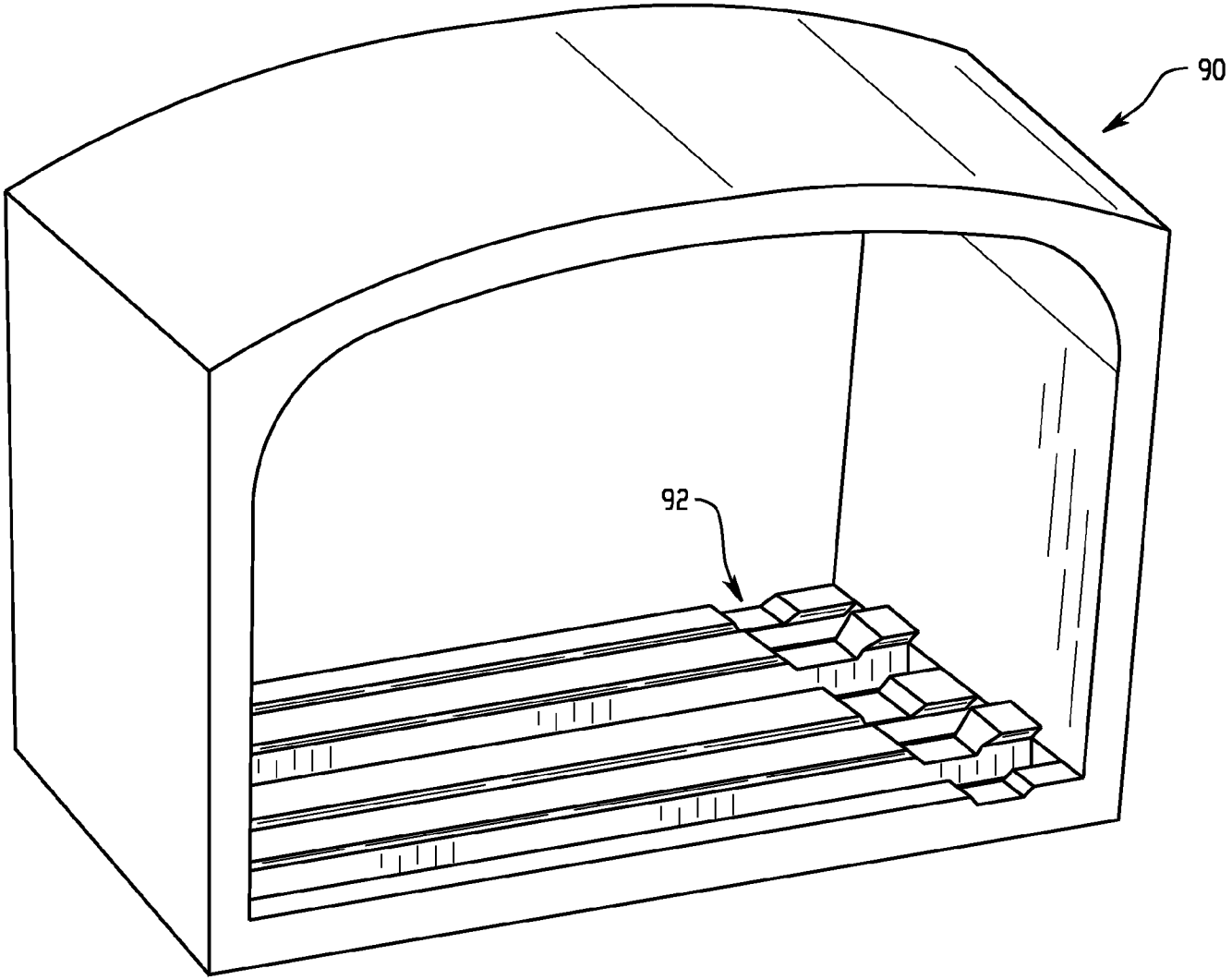
FIG. 20A-C show another embodiment of a bridge unit.
Figure 20B:
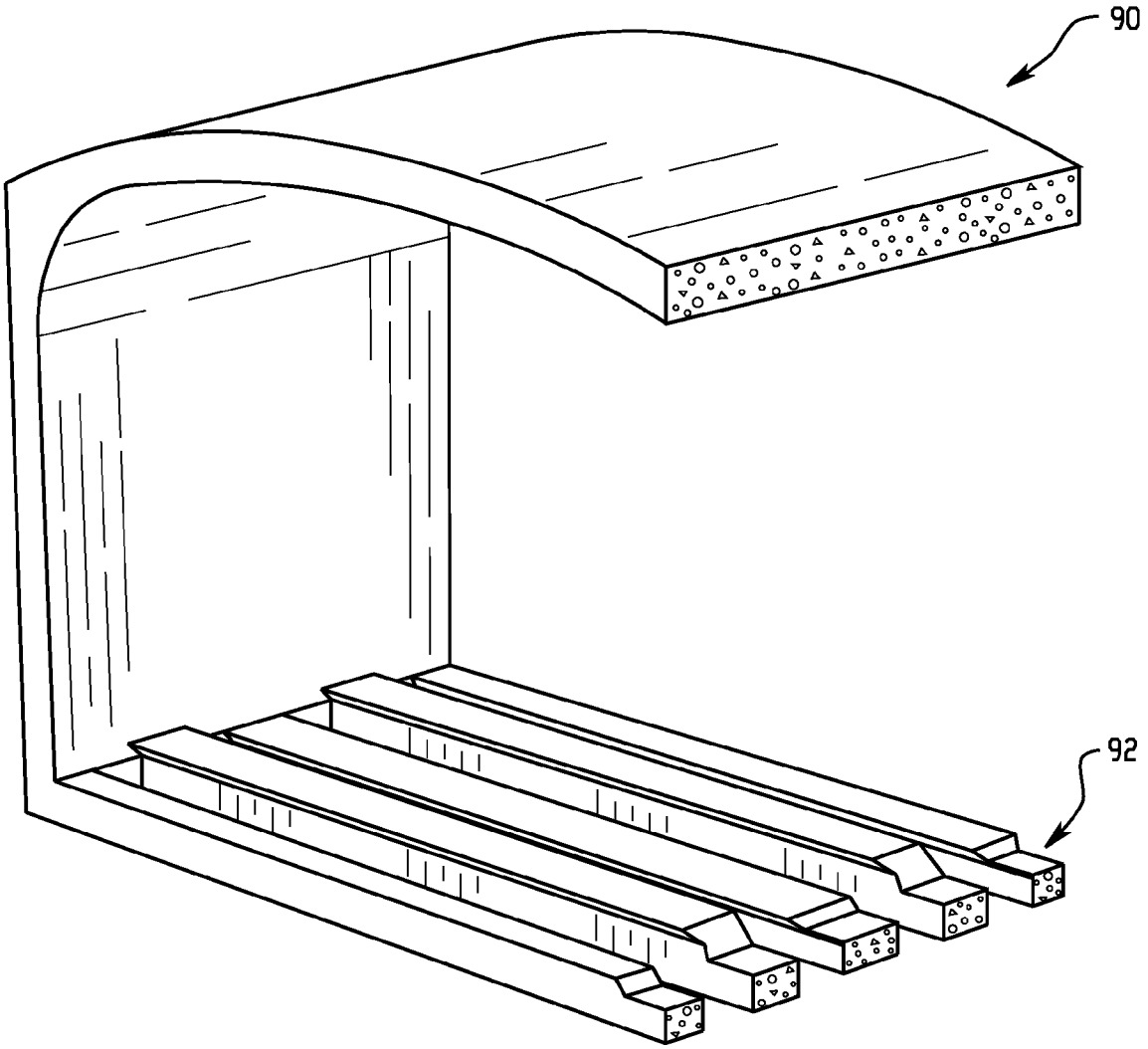
Figure 20C:
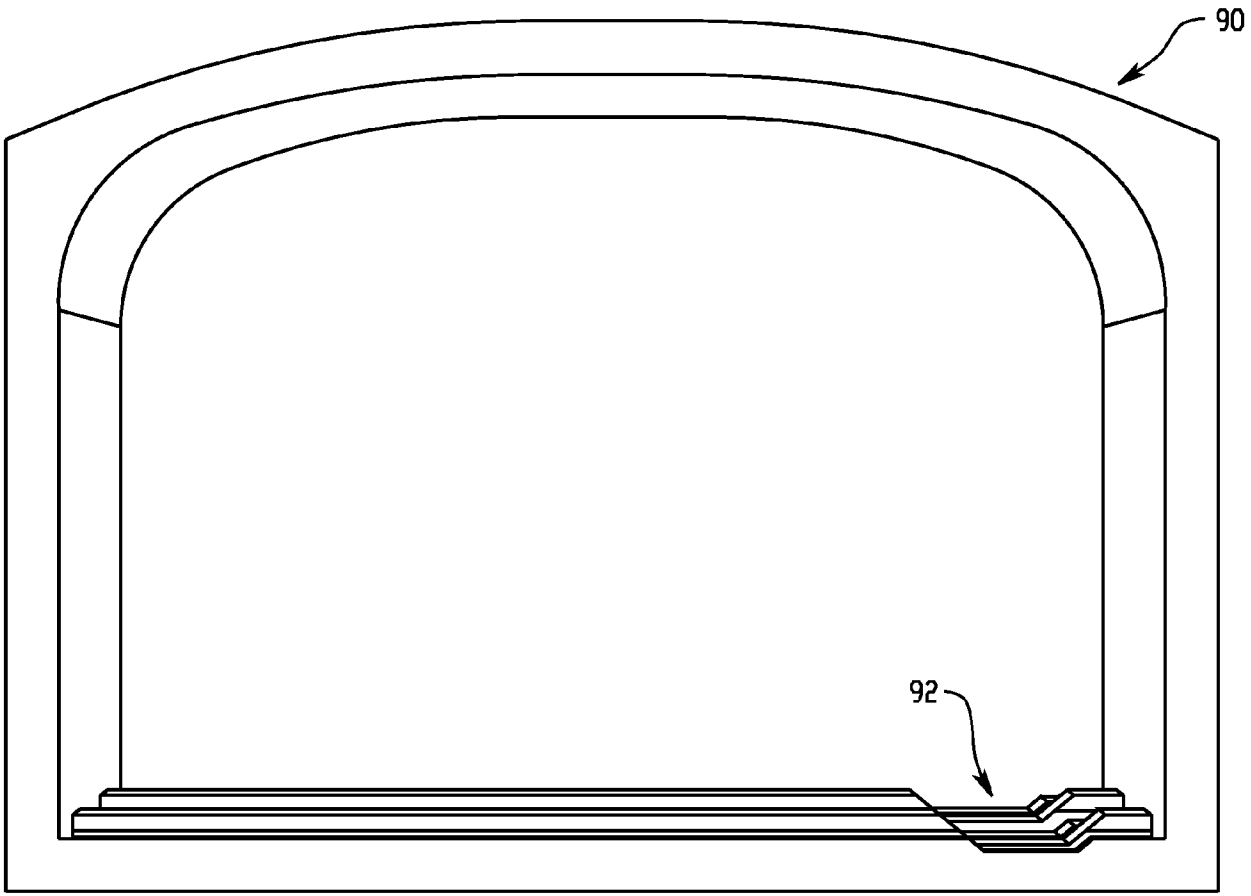
Figure 21A:
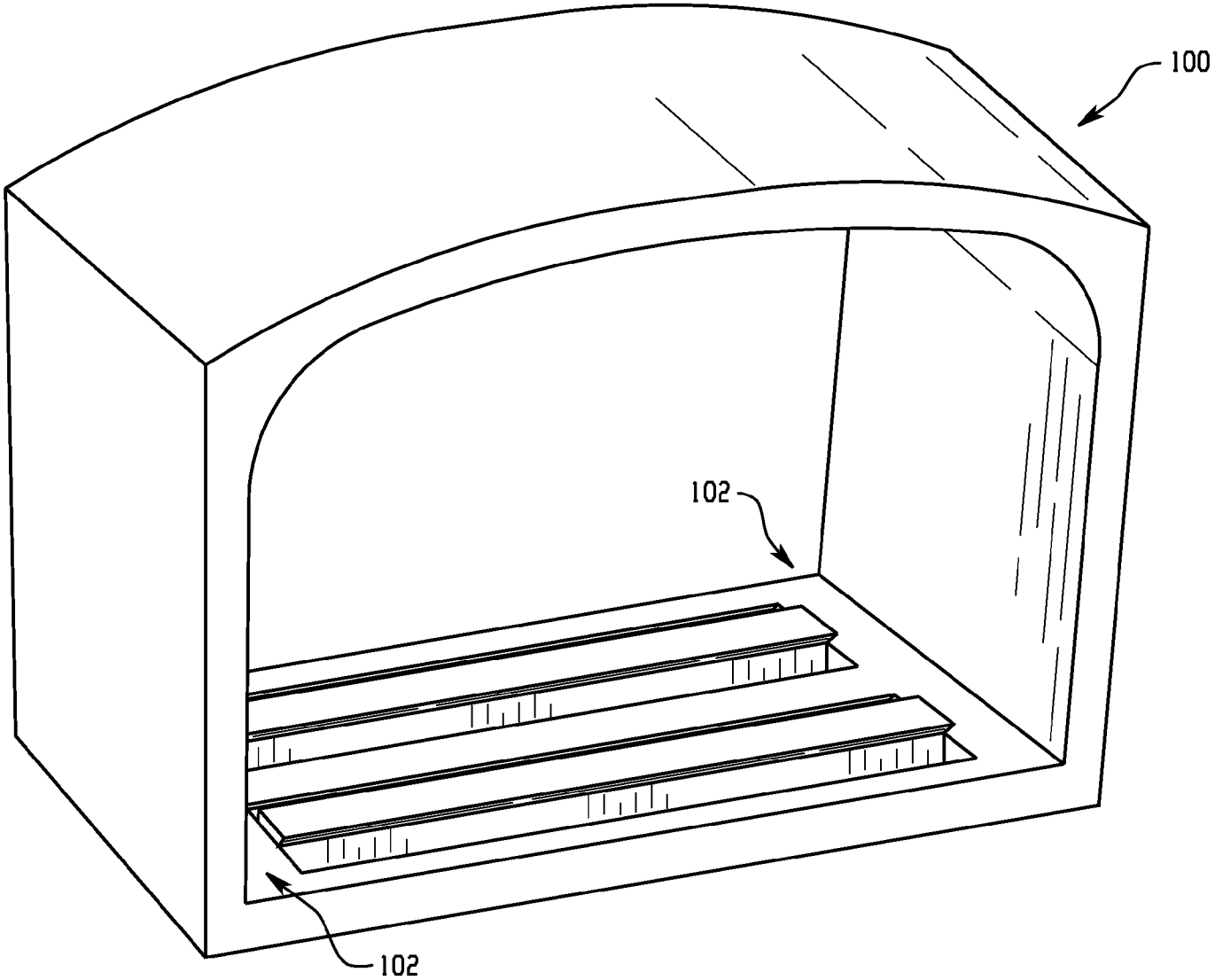
FIG. 21A-C show another embodiment of a bridge unit.
Figure 21B:
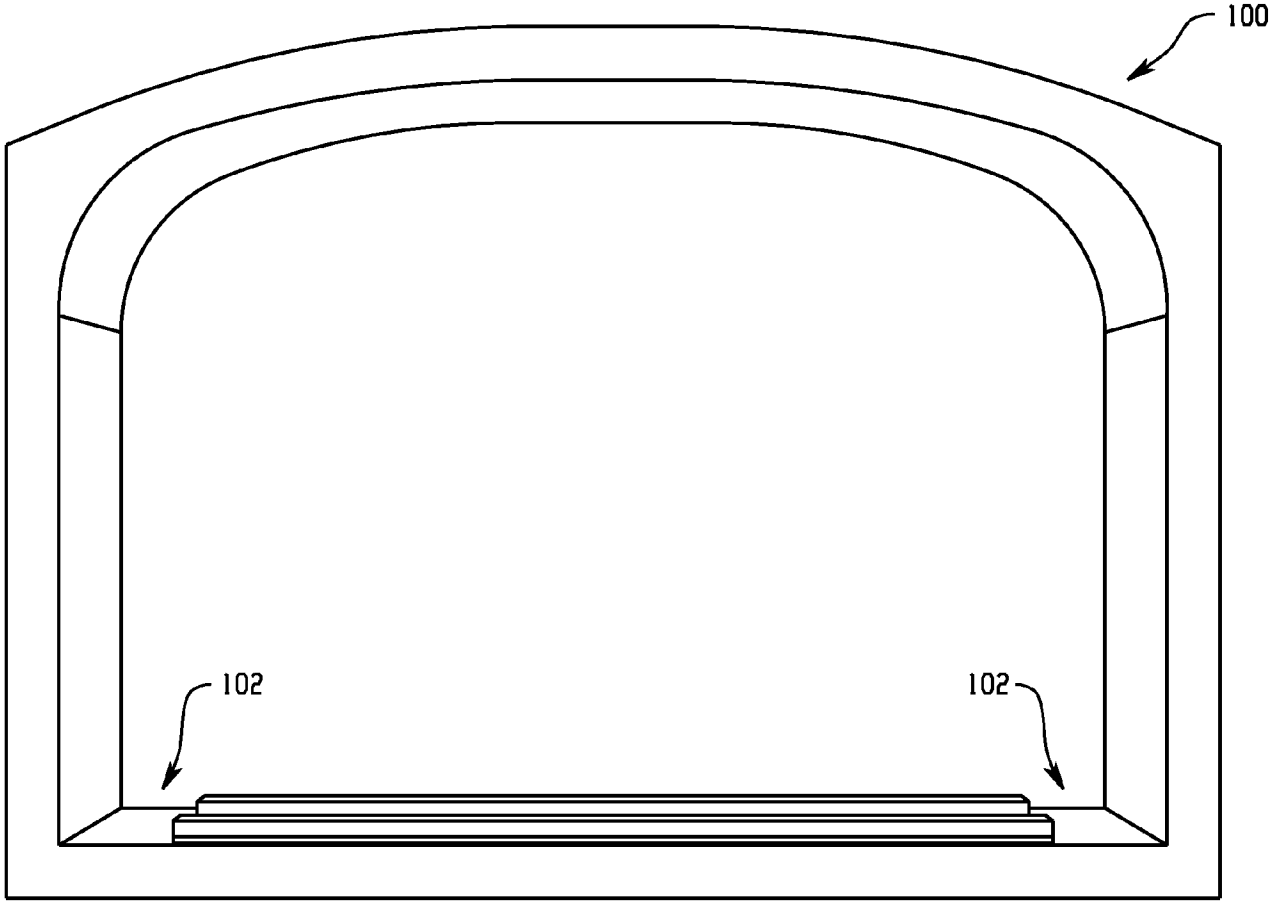
Figure 21C:
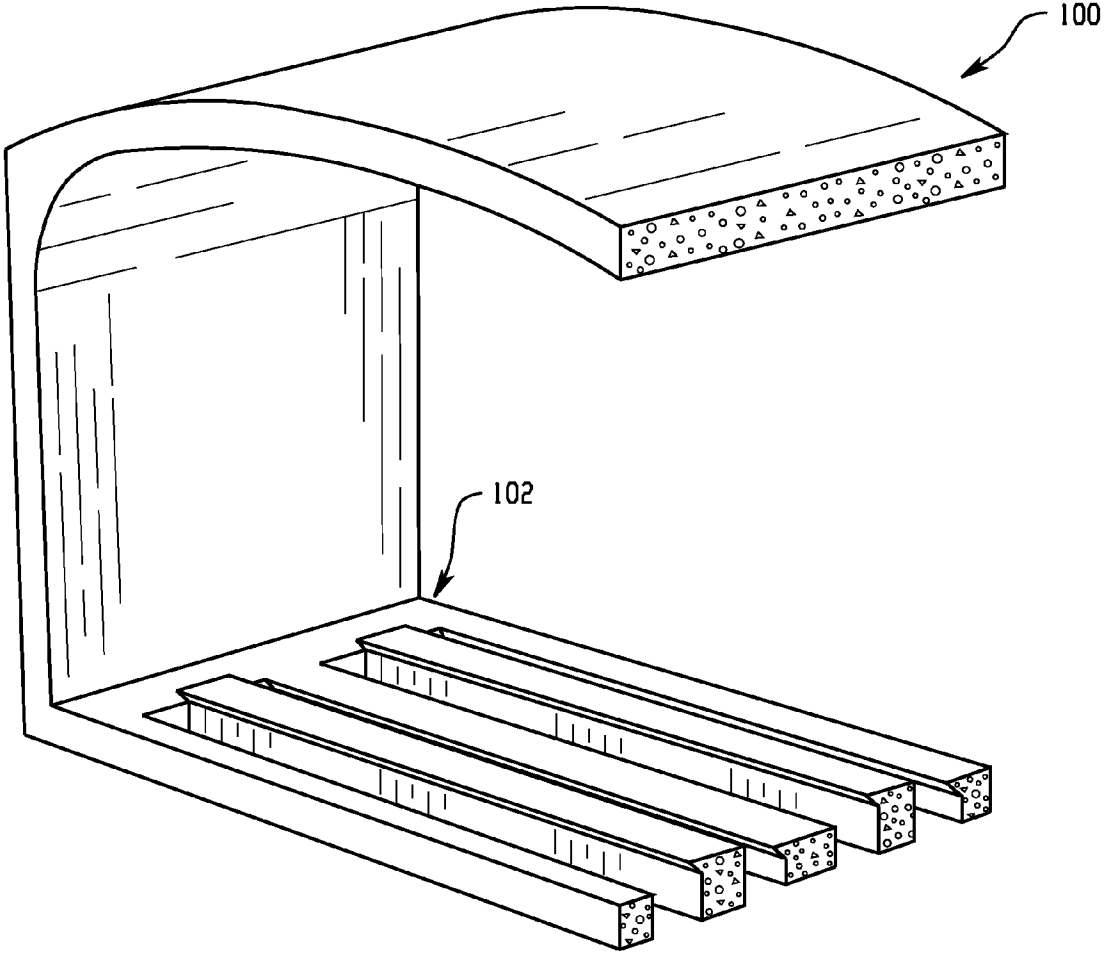

It is to be clearly understood that the above description is intended by way of illustration and example only and is not intended to be taken by way of limitation, and that changes and modifications are possible. For example, other possible unit configurations are reflected in FIGS. 19A-B, 20A-C and 21A-C. For reference, the unit 90 of FIGS. 19A-B includes lengthwise extending openings 82 having ends adjacent the side walls 84, alternatingly raised 86 and lowered 88 beams and upstream facing lips, with no haunches or gusseting between the bottom wall and the side walls. The unit 90 of FIGS. 20A-C is similar to that of FIGS. 19A-B but also includes reduced thickness sections in the beams to provide a low flow channel 92. The unit 100 of FIGS. 21A-C includes beams and slots with ends spaced from the side walls, and no haunches or gussets, such that the corner areas between the bottom wall and the side walls form low flow areas.

Figure 22:
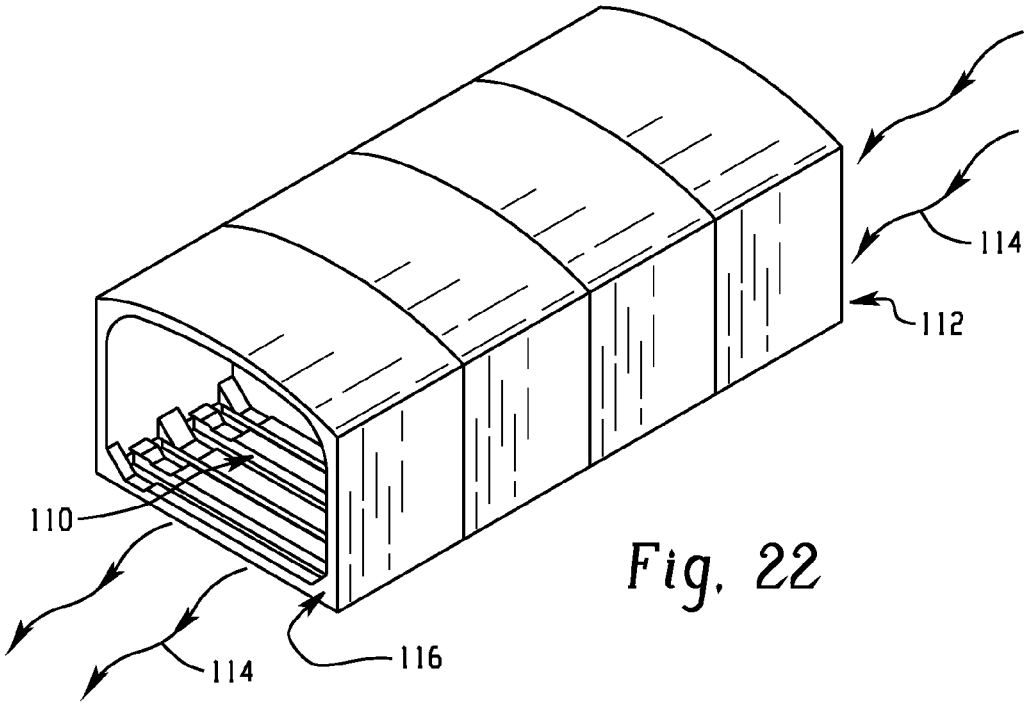
FIG. 22 shows a plurality of four-sided units arranged along a water flow path.
Figure 23:
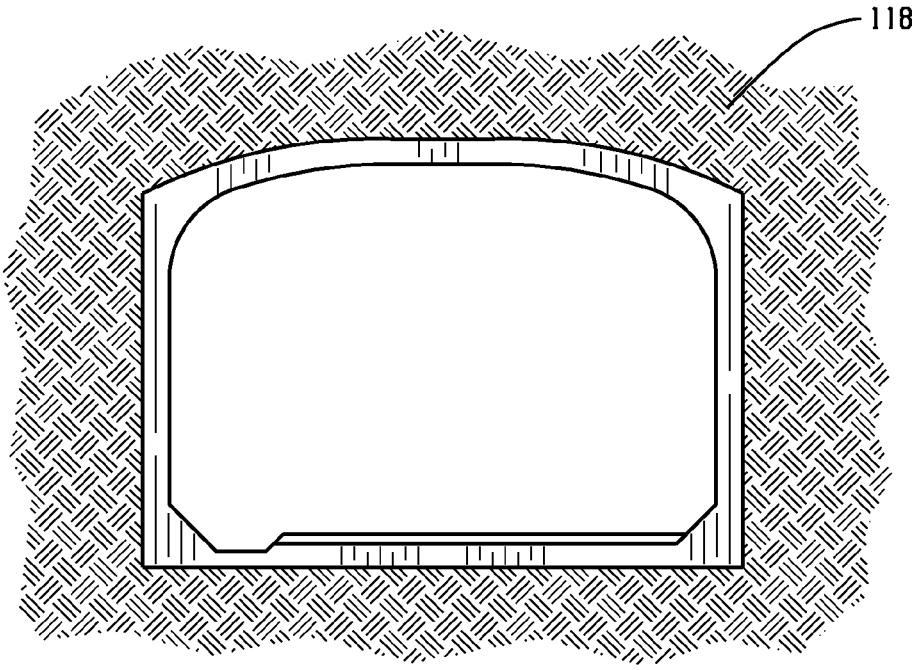
FIG. 23 shows a schematic end elevation of the system of FIG. 22 as buried.
Figure 24:
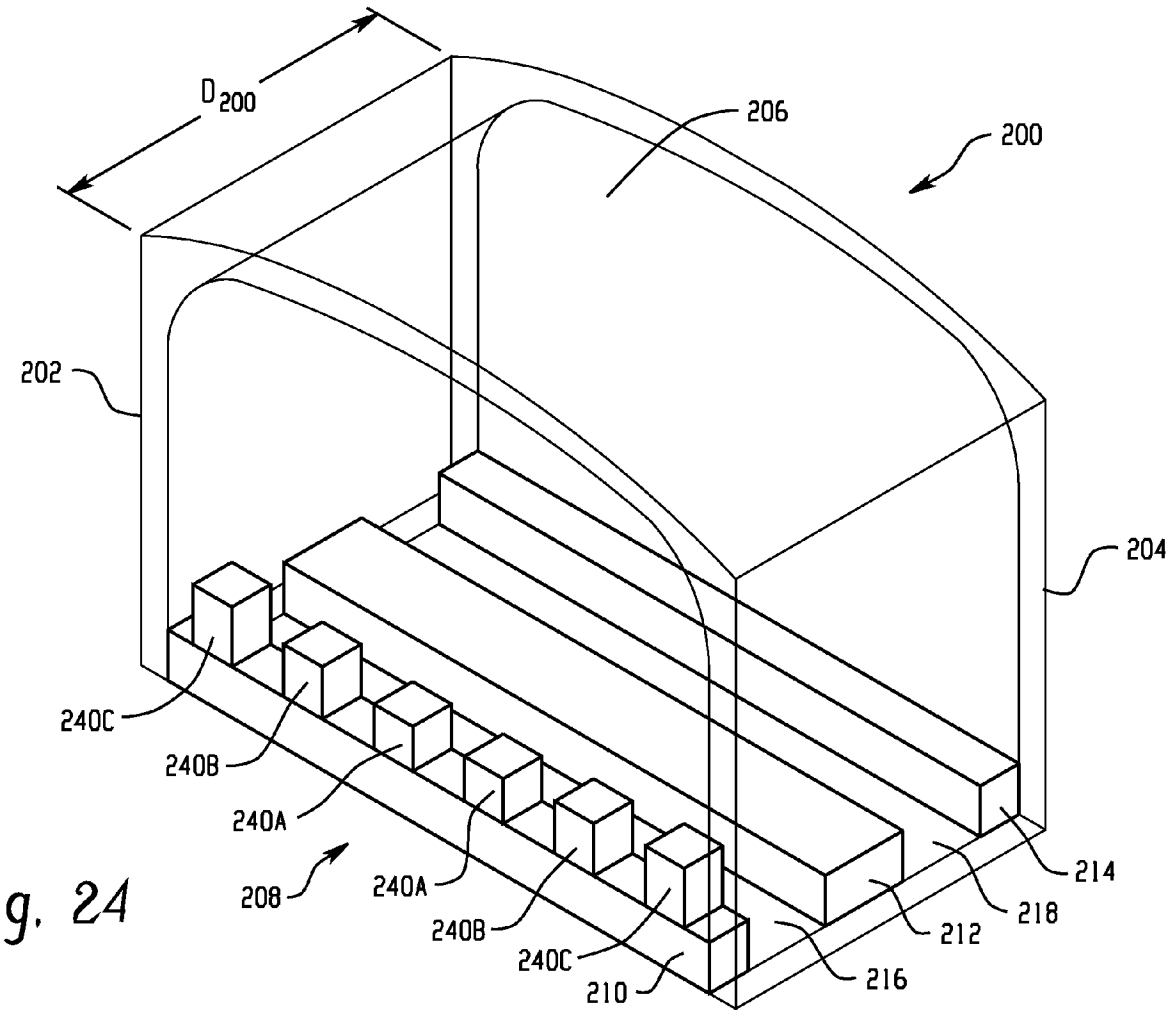
FIG. 24 shows a perspective view of another embodiment of a bridge unit.
Figure 25:
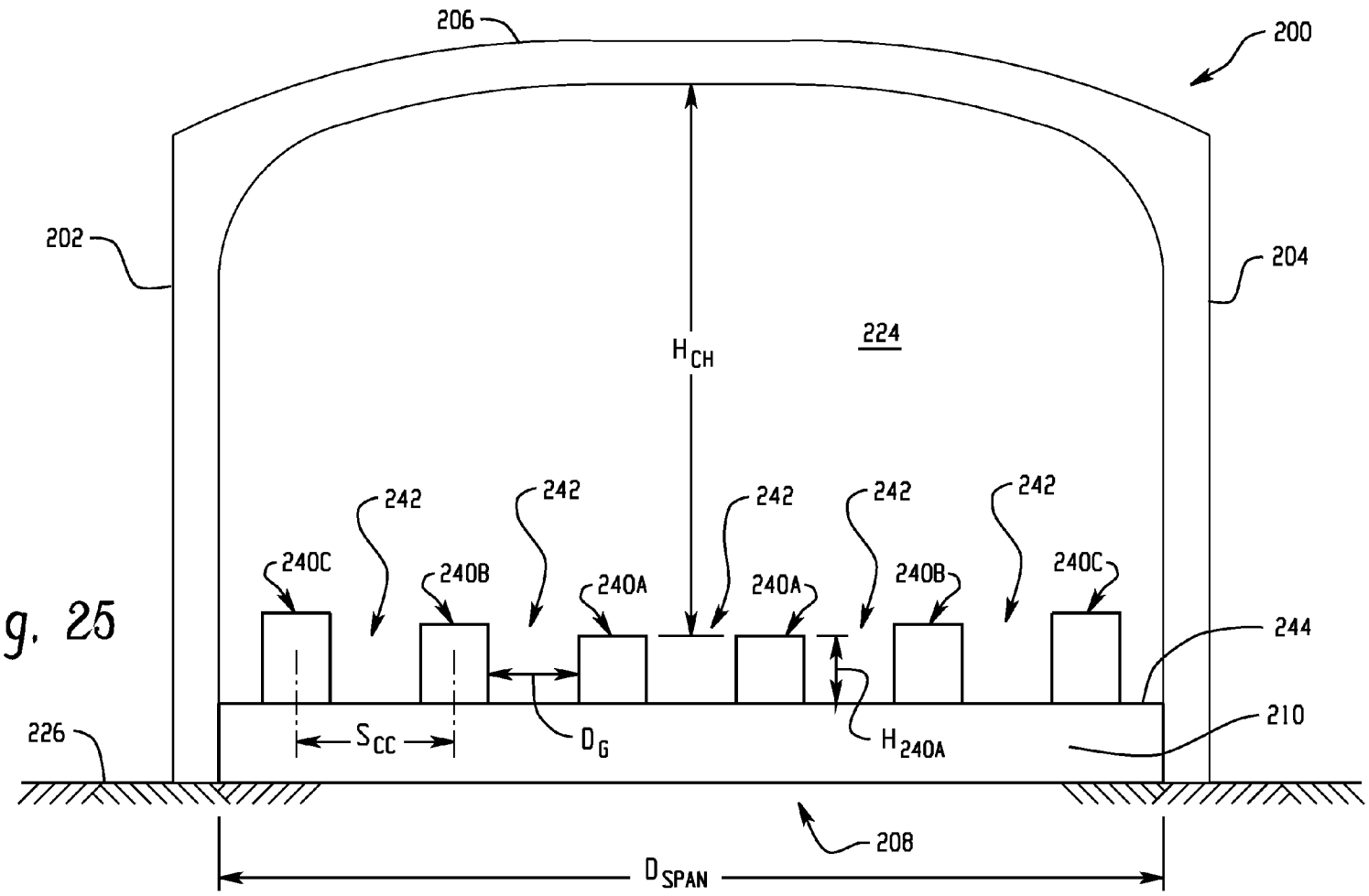
FIG. 25 shows an end view of the bridge unit of FIG. 24.
Figure 26:
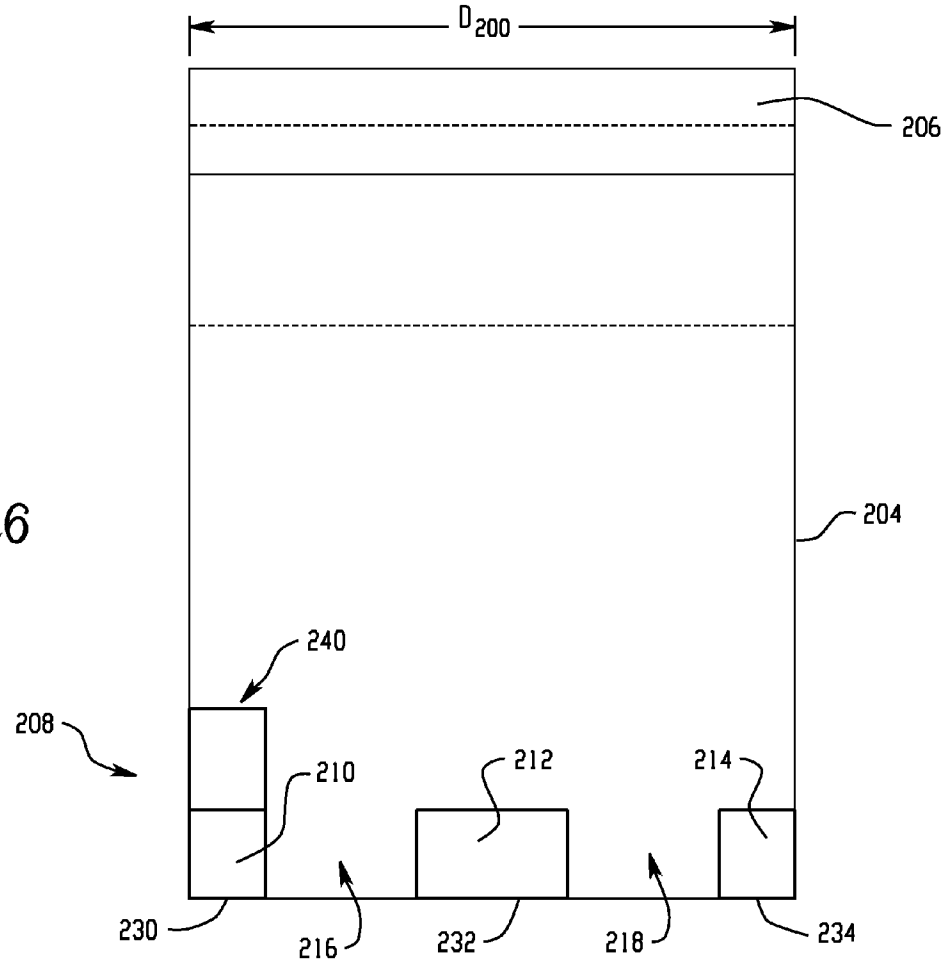
FIG. 26 shows a side view of the bridge unit of FIG. 24.
Figure 27:
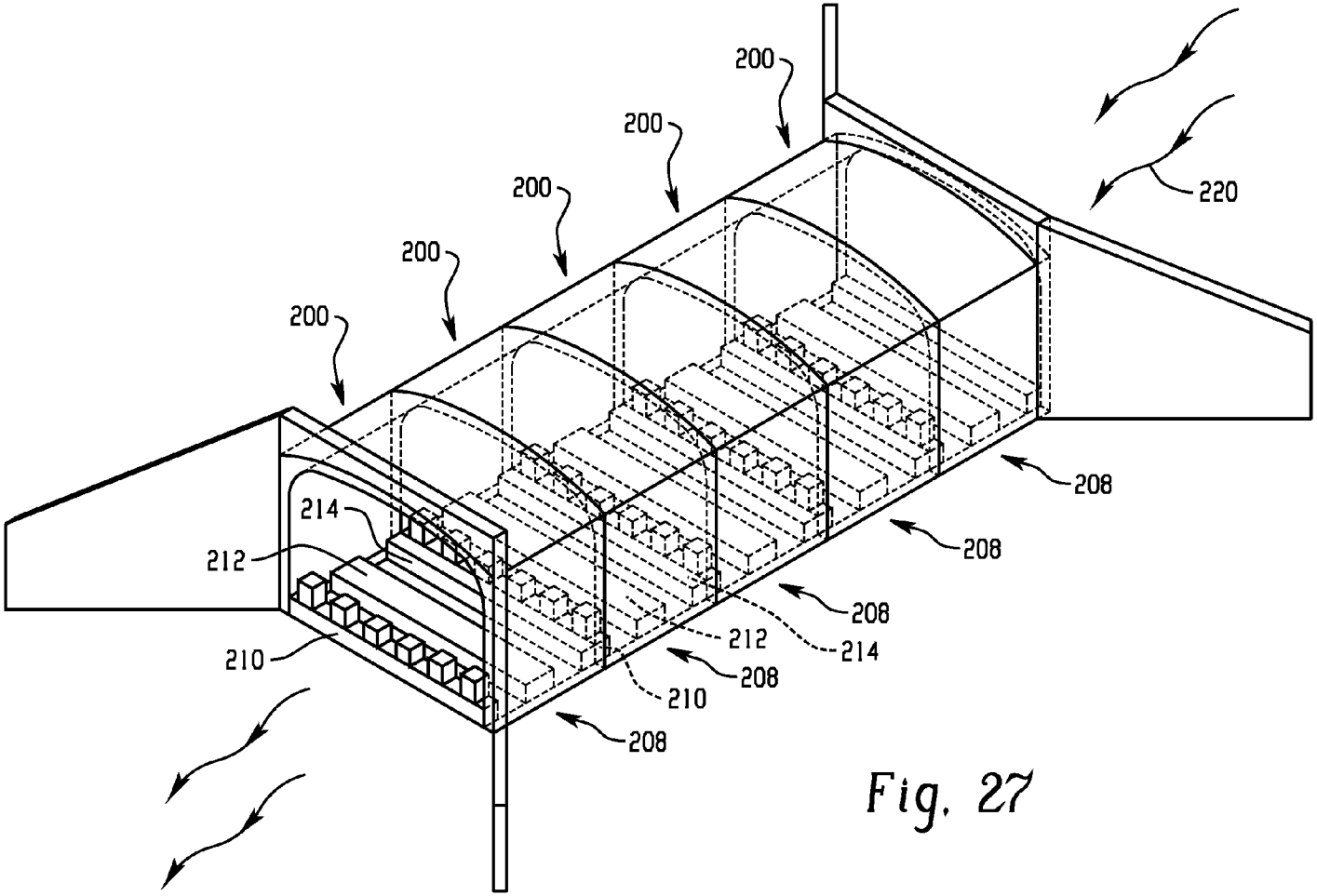
FIG. 27 shows a perspective view of a bridge system formed by abutting multiple bridge units of the type shown in FIG. 24.
Figure 28:
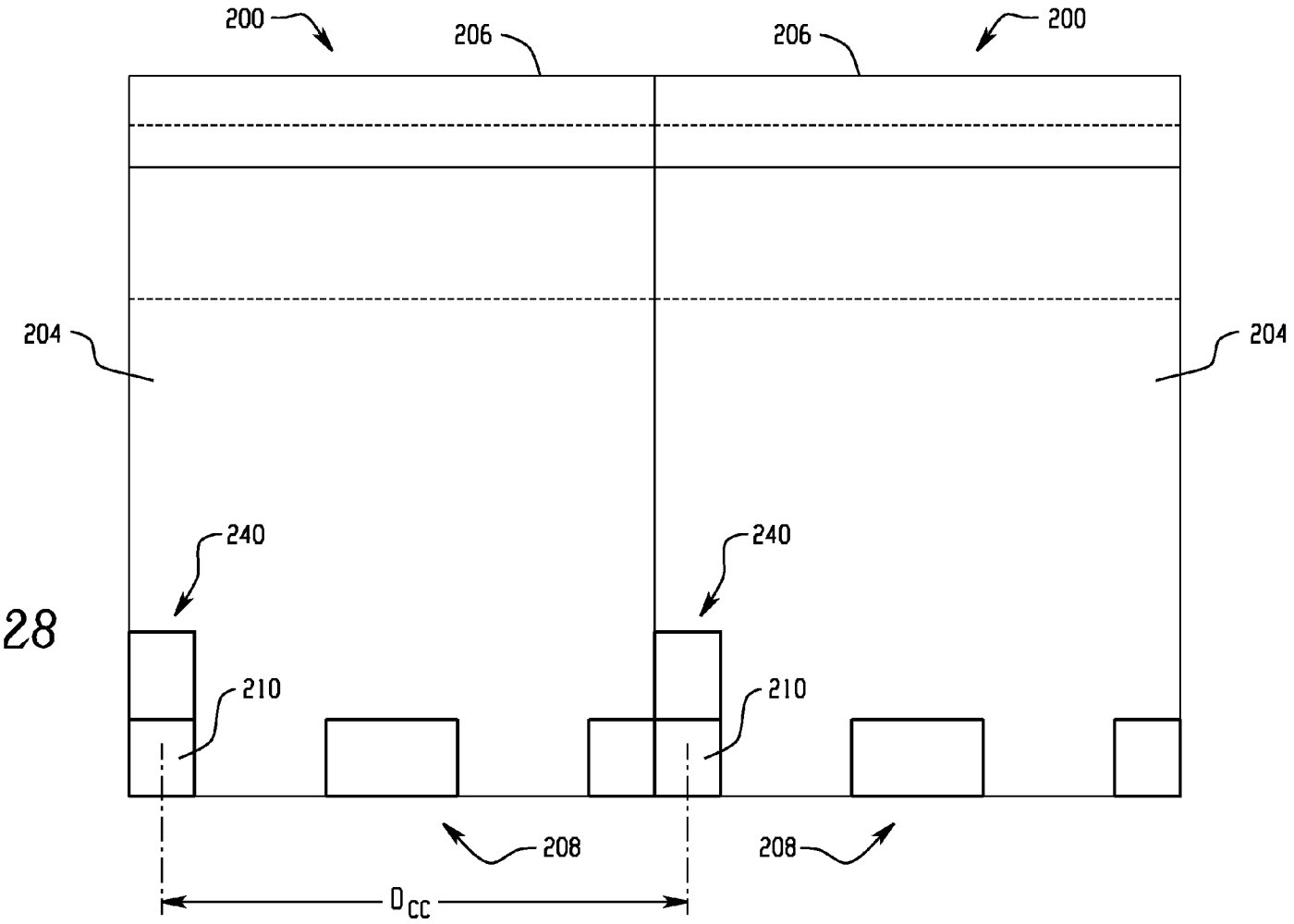
FIG. 28 shows a side view of two abutting bridge units.

FIG. 22 shows a plurality of four-sided concrete bridge units, which could be any of the unit configurations previously described, in abutting relationship to create a surrounded pathway tunnel 110. One end 112 of the tunnel is located upstream along a water path 114 and an opposite end 116 of the tunnel is located downstream along the water path 114. FIG. 23 shows the units in profile as buried in earthen material 118. FIG. 23 could also represent a series of buried units used for the purpose of storm water collection, with infiltration into the surrounding earth occurring through the openings in the bottom walls of the units.

Referring now to FIGS. 24-28, another embodiment of a bridge system is shown in which each precast concrete bridge unit 200 includes opposed side walls 202 and 204 and a top wall 206, which are shown in transparent outline form to facilitate viewing of the bottom configuration. The bottom configuration of each bridge unit is formed by a plurality of precast concrete beams 210, 212, 214 extending from one side wall 202 to the other sidewall 204. The beams are spaced apart along a depth $D_{200}$ of the bridge unit to define a plurality of elongated through openings 216 and 218 for interacting with flowing water 220 and earthen material in flowing water to enhance capture and settling of earthen material. In the illustrated embodiment, each of the plurality of elongated through openings 216, 218 extends from one side wall 202 to the other side wall 204 to provide full span connectivity between a pathway tunnel 224 through the unit and the underlying ground 226 along each elongated through opening 216, 218. Moreover, each elongated precast concrete beam 210, 212, 214 has a bottom side 230, 232, 234 that is in a common plane with a bottom surface of each of the side walls 202, 204 so as to aid in transferring load to ground below the bridge unit.

As shown, at least one elongated precast concrete beam has a configuration that is different than a configuration of another one of the elongated precast concrete beams. In the illustrated embodiment having three beams 210, 212 and 214, the configurations are all distinct in some way. More specifically, beam 210 includes upright sedimentation members 240, whereas beams 212 and 214 do not. Also, the depthwise dimension of beam 212 is larger than the depthwise dimension of both beams 210 and 214.

In preferred implementations the elongated slots 216, 218 are sized such that at least forty percent of the bottom configuration 208 of each bridge unit is open (e.g., at least fifty percent is open).

Referring again to the upwardly projecting sedimentation members 240, such members spaced apart in a spanwise direction DSPAN to define gaps 242 between the sedimentation members 240. Notably, the height of the sedimentation members varies. In particular, more centrally located sedimentation members 240A have heights that are less than heights of the more outward sedimentation members 240B, which in turn have heights that are less than the more outward sedimentation members 240C. In this regard, the height of each sedimentation member is defined relative to the upper surface 244 of the beam (e.g., 210 in this case) from which it extends. In the illustrated embodiment all of the beams 210, 212, 214 all have a common height, resulting in coplanar upper surfaces as between the beams.

By properly configuring and spacing the upright sedimentation members 240, desirable sedimentation can be achieved within a pathway tunnel defined by multiple units, while at the same time facilitating fish passage. In one preferred implementation, each sedimentation member has a height (e.g., $H_{240A}$-defined relative to the upper surface of the beam from which it extends) that is between about ten percent and about twenty-seven percent of a clear height of the pathway tunnel at top dead center). In this regard, the clear height of the pathway tunnel is defined as the dimension $H_{CH}$ between the upper surface of the shortest upright members 240A and the inner surface of the top wall at top dead center of the unit. In a preferred implementation, each gap 242 between the sedimentation members has a horizontal dimension $D_G$ that is between about six percent and about twelve percent of the span $D_{SPAN}$ of the pathway tunnel 224, while a center-to-center spacing $S_{CC}$ between adjacent sedimentation members 240 is between about twelve percent and about seventeen percent of the span $D_{SPAN}$ of the pathway tunnel.

In the illustrated embodiment, at least one of the elongated precast concrete beams (e.g., in this case both beams 212 and 214) lacks any sedimentation members. Utilizing this configuration, a more suitable depthwise center to center spacing $D_{CC}$ along the pathway tunnel between elongated precast concrete beams 210 having sedimentation members can be achieved, where it is preferred that such spacing $D_{CC}$ between about thirty percent and about seventy percent of the span $D_{SPAN}$ of the pathway tunnel. In embodiments where only one beam of each bridge unit includes the sedimentation members and like bridge units are used, the dimension $D_{CC}$ will generally be the same as the depth $D_{200}$ of the bridge units. Where the beam 210 with sedimentation members 240 is located at one end of the bridge unit and a beam 214 with no upright members is located at an opposite end of the bridge unit, upon installation, the beam 210 with sedimentation members will abut against the beam 214 without sedimentation members. Configuring the bridge units such that only one beam has the sedimentation members, and locating that beam at one end of the bridge unit, also facilitates manufacture of the bridge units. More specifically, each bridge unit can be cast on end with top wall and side walls in one pour, and side then beams and baffles cast as a secondary pour. The end baffle configuration/ location eliminates the need to form the baffles off the ground, simplifying production.

Figure 29:
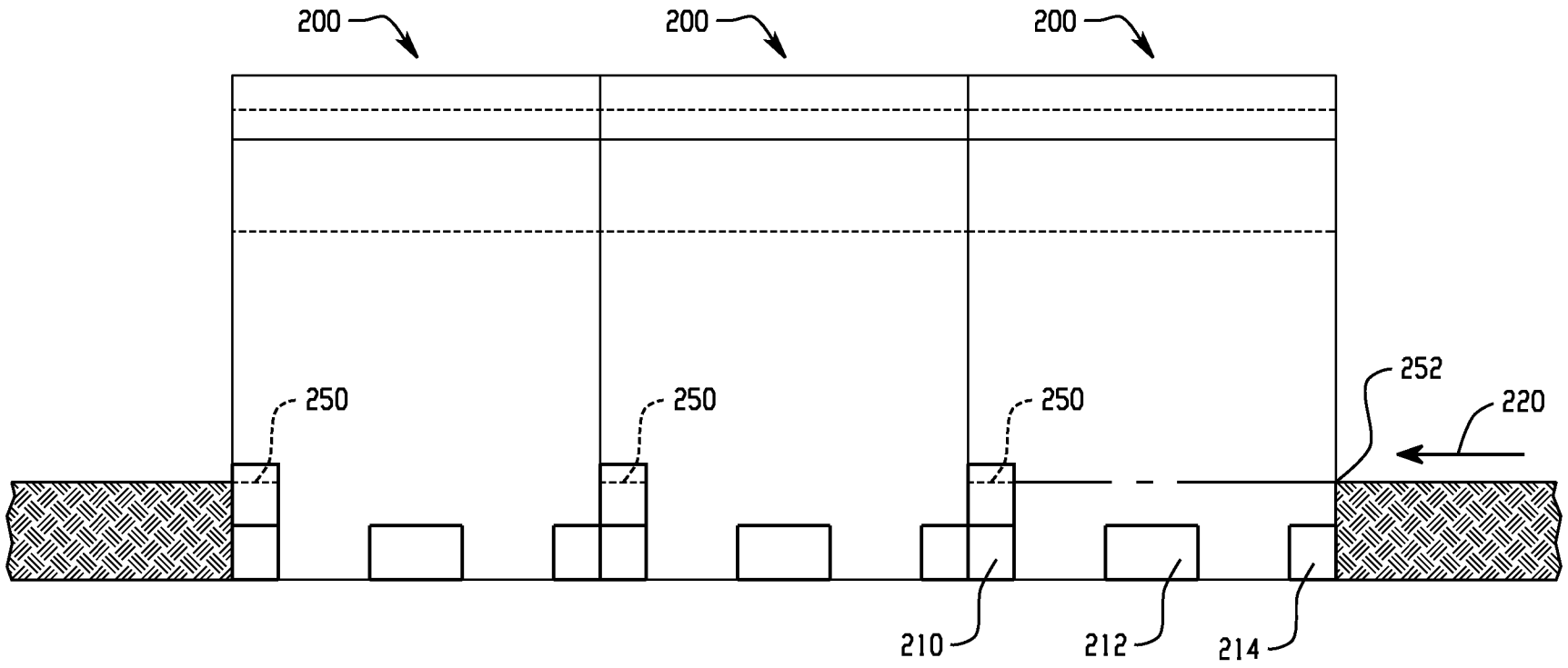
FIG. 29 shows a side view of three abutting bridge units.

As noted above, the sedimentation members have different heights. To achieve desirable sedimentation results within the pathway tunnel, the install elevation of the bridge units is desirably matched with the invert of the natural water flow path feeding into the pathway tunnel. More specifically, and referring to FIG. 29, the top surface of the shorter sedimentation units is represented by dashed line 250, which is shown at substantially the same elevation as the invert 252 of the incoming water flow path. Thus, the upper surfaces of the precast concrete beams are all located below the incoming invert 252 at the time of on-site installation of the units.

Figure 30:
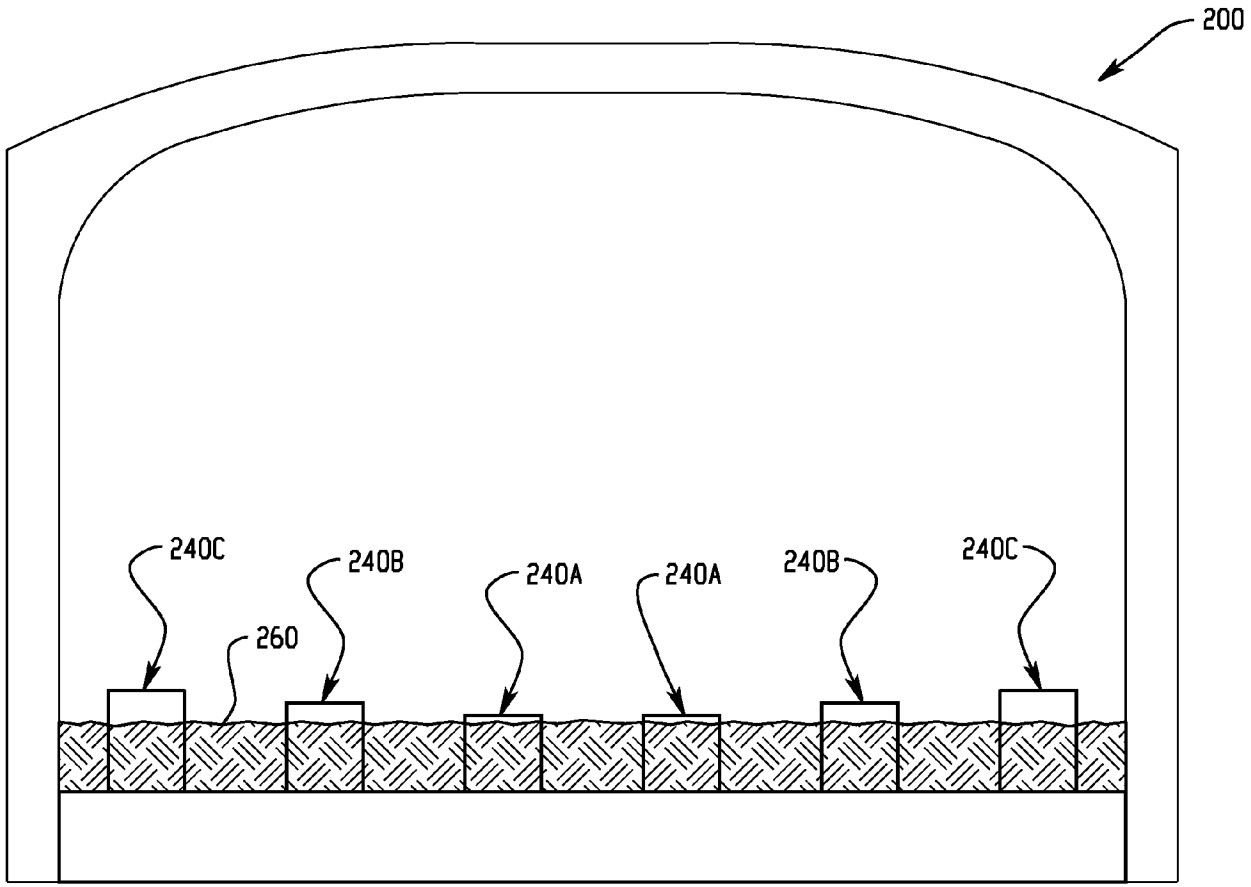
FIG. 30 shows an end view depicting resulting sedimentation within the pathway tunnel.

Utilizing sedimentation members of different heights also facilitates fish passage. In particular, referring to FIG. 30, the resulting sedimentation achieved within the pathway tunnel is depicted as 260, where it is seen that the although the shorter sedimentation members 240A are substantially covered, the taller sedimentation members 240B and 240C are more exposed, meaning that they remain capable of reducing water flow velocity in tunnel regions aligned with such members, creating areas of lower velocity for fish passage.

Other embodiments are contemplated and modifications and changes could be made without departing from the scope of this application. For example, while the primary embodiments contemplate four-sided bridge units it is recognized that other variations could be implemented. For example, the bottom configuration depicted in FIGS. 24-28 could be implemented utilizing a set of precast or cast-in-place bottom modules, and the pathway tunnel 224 completed by other structure such as metal plate of any suitable arch or arch-like configuration.

What is claimed is:

1. A bridge system for providing a surrounded water flow pathway tunnel adapted to produce an environmentally-friendly tunnel bottom, the system comprising:

a plurality of four-sided precast concrete bridge units in abutting relationship to create the surrounded water flow pathway tunnel, one end of the pathway tunnel located upstream along a natural water path and an opposite end of the pathway tunnel located downstream along the natural water path, wherein each of the four-sided precast concrete bridge units includes: spaced apart side walls interconnected by a top wall, and a bottom configuration formed by a plurality of elongated precast concrete beams extending from one side wall to the other side wall and that are spaced apart along a depth of the bridge unit to define a plurality of elongated through-openings for interacting with flowing water and earthen material in flowing water to enhance capture and settling of earthen material along the pathway tunnel, wherein each of the plurality of elongated through-openings extends from one side wall to the other side wall to provide full span connectivity between the pathway tunnel and the underlying ground along each elongated through-opening, each elongated precast concrete beam having a bottom side that is in a common plane with a bottom surface of each of the side walls so as to aid in transferring load to ground below the bridge unit, wherein at least one elongated precast concrete beam has a configuration that is different than a configuration of another one of the elongated precast concrete beams;

wherein at least forty percent of the bottom configuration of each of the four-sided precast concrete bridge units is open;

wherein, in the case of each of the four-sided precast concrete bridge units, at least one elongated precast concrete beam has a depth that is greater than a depth of another one of the elongated precast concrete beams;

wherein, in the case of each of the four-sided precast concrete bridge units, at least one elongated precast concrete beam includes a plurality of upwardly-projecting sedimentation members spaced apart in a spanwise direction to define gaps between the sedimentation members, at least one sedimentation member having a height that is different than a height of another sedimentation member, each sedimentation member having a height that is between about ten percent and about twenty-seven percent of a clear height of the pathway tunnel at top dead center, each gap between the sedimentation members is between about six percent and about twelve percent of a span of the pathway tunnel, a center-to-center spacing between adjacent sedimentation members is between about twelve percent and about seventeen percent of the span of the pathway tunnel, and sedimentation members located toward the side walls have heights that are greater than heights of sedimentation members located centrally along the span of the pathway tunnel;

wherein, in the case of each of the four-sided precast concrete bridge units, at least one of the elongated precast concrete beams lacks any sedimentation members, such that a depthwise center-to-center spacing along the pathway tunnel between elongated precast concrete beams having sedimentation members is between about thirty percent and about seventy percent of the span of the pathway tunnel; and wherein, in the case of each of the four-sided precast concrete bridge units, a first one of the elongated precast concrete beams at one end of the bridge unit lacks any sedimentation members and a second one of the elongated precast beams at an opposite end of the bridge unit includes sedimentation members, and the plurality of four-sided precast concrete bridge units are arranged such that, in the case of adjacent bridge units, the first elongated precast concrete beam of one bridge unit abuts the second elongated precast concrete beam of the other bridge unit.

2. A bridge system for providing a surrounded water flow pathway tunnel adapted to produce an environmentally-friendly tunnel bottom, the system comprising:

a plurality of four-sided precast concrete bridge units in abutting relationship to create the surrounded water flow pathway tunnel, one end of the pathway tunnel located upstream along a natural water path and an opposite end of the pathway tunnel located downstream along the natural water path, wherein each of the four-sided precast concrete bridge units includes:

spaced apart side walls interconnected by a top wall, and a bottom configuration formed by a plurality of elongated precast concrete beams extending from one side wall to the other side wall and that are spaced apart along a depth of the bridge unit to define a plurality of elongated through-openings for interacting with flowing water and earthen material in flowing water to enhance capture and settling of earthen material along the pathway tunnel, wherein each of the plurality of elongated through-openings extends from one side wall to the other side wall to provide full span connectivity between the pathway tunnel and the underlying ground along each elongated through-opening, each elongated precast concrete beam having a bottom side that is in a common plane with a bottom surface of each of the side walls so as to aid in transferring load to ground below the bridge unit, wherein at least one elongated precast concrete beam has a configuration that is different than a configuration of another one of the elongated precast concrete beams;

wherein, in the case of each of the four-sided precast concrete bridge units, at least one elongated precast concrete beam includes a plurality of upwardly-projecting and fixed sedimentation members spaced apart in a spanwise direction to define gaps between the sedimentation members;

wherein, in the case of each of the four-sided precast concrete bridge units, at least one of the elongated precast concrete beams lacks any sedimentation members, such that a depthwise center-to-center spacing along the pathway tunnel between elongated precast concrete beams having sedimentation members is between about thirty percent and about seventy percent of a span of the pathway tunnel.

3. A bridge system for providing a surrounded water flow pathway tunnel adapted to produce an environmentally-friendly tunnel bottom, the system comprising:

a plurality of four-sided precast concrete bridge units in abutting relationship to create the surrounded water flow pathway tunnel, one end of the pathway tunnel located upstream along a natural water path and an opposite end of the pathway tunnel located downstream along the natural water path, wherein each of the four-sided precast concrete bridge units includes:

spaced apart side walls interconnected by a top wall, and a bottom configuration formed by a plurality of elongated precast concrete beams extending from one side wall to the other side wall and that are spaced apart along a depth of the bridge unit to define a plurality of elongated through-openings for interacting with flowing water and earthen material in flowing water to enhance capture and settling of earthen material along the pathway tunnel, wherein each of the plurality of elongated through-openings extends from one side wall to the other side wall to provide full span connectivity between the pathway tunnel and the underlying ground along each elongated through-opening, each elongated precast concrete beam having a bottom side that is in a common plane with a bottom surface of each of the side walls so as to aid in transferring load to ground below the bridge unit, wherein at least one elongated precast concrete beam has a configuration that is different than a configuration of another one of the elongated precast concrete beams;

wherein, in the case of each of the four-sided precast concrete bridge units, at least one elongated precast concrete beam includes a plurality of upwardly-projecting sedimentation members spaced apart in a spanwise direction to define gaps between the sedimentation members;

wherein, in the case of each of the four-sided precast concrete bridge units, a first one of the elongated precast concrete beams at one end of the bridge unit lacks any sedimentation members and a second one of the elongated precast beams at an opposite end of the bridge unit includes sedimentation members, and the plurality of four-sided precast concrete bridge units are arranged such that, in the case of adjacent bridge units, the first elongated precast concrete beam of one bridge unit abuts the second elongated precast concrete beam of the other bridge unit.

4. A bridge system for providing a surrounded water flow pathway tunnel adapted to produce an environmentally-friendly tunnel bottom, the system comprising:

a plurality of four-sided precast concrete bridge units in abutting relationship to create the surrounded water flow pathway tunnel, one end of the pathway tunnel located upstream along a natural water path and an opposite end of the pathway tunnel located downstream along the natural water path, wherein each of the four-sided precast concrete bridge units includes:

spaced apart side walls interconnected by a top wall, and a bottom configuration formed by a plurality of elongated precast concrete beams extending from one side wall to the other side wall and that are spaced apart along a depth of the bridge unit to define a plurality of elongated through-openings for interacting with flowing water and earthen material in flowing water to enhance capture and settling of earthen material along the pathway tunnel, wherein each of the plurality of elongated through-openings extends from one side wall to the other side wall to provide full span connectivity between the pathway tunnel and the underlying ground along each elongated through-opening, each elongated precast concrete beam having a bottom side that is in a common plane with a bottom surface of each of the side walls so as to aid in transferring load to ground below the bridge unit, wherein at least one elongated precast concrete beam has a configuration that is different than a configuration of another one of the elongated precast concrete beams;

wherein, in the case of each of the four-sided precast concrete bridge units, at least one elongated precast concrete beam includes a plurality of upwardly-projecting sedimentation members spaced apart in a spanwise direction to define gaps between the sedimentation members;

wherein, in the case of each of the four-sided precast concrete bridge units, sedimentation members located toward the side walls have heights that are greater than heights of sedimentation members located towards a spanwise center of the pathway tunnel.

5. The system of claim 4 wherein at least a most upstream one of the bridge units is installed such that a top of a shortest one of the sedimentation members of the most upstream bridge unit is substantially aligned in height with an invert of the incoming water flow path.

6. A method of constructing a bridge system for providing a surrounded water flow pathway tunnel adapted to produce an environmentally-friendly tunnel bottom, the method comprising:

utilizing a plurality of precast concrete bridge units, each bridge unit including:

spaced apart side walls interconnected by a top wall, and a bottom configuration formed by a plurality of elongated precast concrete beams extending from one side wall to the other side wall and that are spaced apart along a depth of the bridge unit to define a plurality of elongated through-openings for interacting with flowing water and earthen material in flowing water to enhance capture and settling of earthen material along the pathway tunnel, wherein each of the plurality of elongated through-openings extends from one side wall to the other side wall, wherein at least one elongated precast concrete beam includes a plurality of upwardly-projecting sedimentation members spaced apart in a spanwise direction to define gaps between the sedimentation members, at least one sedimentation member having a height that is different than a height of another sedimentation member;

installing the bridge units along a water flow path to create the surrounded water flow pathway tunnel, wherein at least a most upstream one of the bridge units is installed such that a top of a shortest one of the sedimentation members is substantially aligned in height with an invert of the water flow path.

7. The method of claim 6 wherein, in the case of each of the four-sided precast concrete bridge units, a first one of the elongated precast concrete beams at one end of the bridge unit lacks any sedimentation members and a second one of the elongated precast beams at an opposite end of the bridge unit includes sedimentation members, and the plurality of four-sided precast concrete bridge units are installed such that, in the case of adjacent bridge units, the first elongated precast concrete beam of one bridge unit abuts the second elongated precast concrete beam of the other bridge unit.

8. The method of claim 6 wherein, in the case of each of the four-sided precast concrete bridge units, one or more of the following conditions exists:

each sedimentation member has a height that is between about ten percent and about twenty-seven percent of a clear height of the pathway tunnel at top dead center;

each gap between the sedimentation members is between about six percent and about twelve percent of a span of the tunnel; or at least one of the elongated precast concrete beams lacks any sedimentation members, such that a depthwise spacing along the pathway tunnel between elongated precast concrete beams having sedimentation members is between about thirty percent and about seventy percent of the span of the tunnel.

9. A bridge system for providing a surrounded water flow pathway tunnel adapted to produce an environmentally-friendly tunnel bottom, the system comprising:

a surrounded water flow pathway tunnel, one end of the pathway tunnel located upstream along a natural water path and an opposite end of the pathway tunnel located downstream along the natural water path, wherein the pathway tunnel has a bottom configuration formed by a plurality of elongated concrete beams extending from one side to the other side of the pathway tunnel and that are spaced apart along the pathway tunnel to define a plurality of elongated through-openings for interacting with flowing water and earthen material in flowing water to enhance capture and settling of earthen material along the pathway tunnel, wherein each of the plurality of elongated through-openings extends from one side to the other side of the pathway tunnel to provide full span connectivity between the pathway tunnel and the underlying ground along each elongated through-opening;

wherein at least forty percent of the bottom configuration of the pathway tunnel is open;

wherein, multiple elongated concrete beams each include a plurality of upwardly-projecting sedimentation members spaced apart in a spanwise direction to define gaps between the sedimentation members, wherein at least one sedimentation member of each of the multiple beams has a height that is different than a height of another sedimentation member of the same beam;

wherein, each sedimentation member has a height that is between about ten percent and about twenty-seven percent of a clear height of the pathway tunnel at top dead center;

wherein, in the case of each of the multiple elongated concrete beams, each gap between the sedimentation members is between about six percent and about twelve percent of a span of the pathway tunnel;

wherein, in the case of each of the multiple elongated concrete beams, a center-to-center spacing between adjacent sedimentation members is between about twelve percent and about seventeen percent of the span of the pathway tunnel;

wherein, the multiple elongated concrete beams are separated from each other by one or more elongated concrete beams that lack any sedimentation members, such that a depthwise center-to-center spacing along the pathway tunnel between elongated concrete beams having sedimentation members is between about thirty percent and about seventy percent of the span of the pathway tunnel.

10. The system of claim 9 wherein the surrounded water flow pathway tunnel is formed by one of (1) a plurality of four-sided precast concrete bridge units placed in abutting relationship or (2) one or more precast concrete base units forming the bottom configuration of the pathway tunnel and one or more metal plate structures forming a remainder of a surrounding perimeter of the pathway tunnel.

11. A bridge system for providing a surrounded water flow pathway tunnel adapted to produce an environmentally-friendly tunnel bottom, the system comprising:

at least one four-sided concrete bridge arrangement to create the surrounded water flow pathway tunnel, one end of the pathway tunnel located upstream along a natural water path and an opposite end of the pathway tunnel located downstream along the natural water path, wherein the four-sided concrete bridge arrangement includes spaced apart side walls, a top wall, and a bottom configuration formed by a plurality of elongated concrete beams extending in a spanwise direction and that are spaced apart along a depth of the bridge arrangement to define a plurality of elongated through-openings for interacting with flowing water and earthen material in flowing water for capture and settling of earthen material along the pathway tunnel, wherein each elongated concrete beam has a bottom side that is in a common plane with a bottom surface of each of the side walls, wherein at least one elongated concrete beam has a configuration that is different than a configuration of another one of the elongated concrete beams, wherein multiple elongated concrete beams each include a plurality of upwardly-projecting sedimentation members spaced apart in the spanwise direction to define gaps between the sedimentation members; and wherein, on at least one of the multiple elongated concrete beams, sedimentation members located toward the side walls have heights that are greater than a height of at least one sedimentation member located towards a spanwise center of the pathway tunnel.

* * * * *